US007804469B2

(12) United States Patent
Asano

(10) Patent No.: US 7,804,469 B2
(45) Date of Patent: Sep. 28, 2010

(54) DISPLAY APPARATUS AND DRIVING METHOD FOR DISPLAY APPARATUS

(75) Inventor: Mitsuru Asano, Kanagawa (JP)

(73) Assignee: Sony Corporation, Tokyo (JP)

( * ) Notice: Subject to any disclaimer, the term of this patent is extended or adjusted under 35 U.S.C. 154(b) by 677 days.

(21) Appl. No.: 11/878,672

(22) Filed: Jul. 26, 2007

(65) Prior Publication Data

US 2008/0030446 A1 Feb. 7, 2008

(30) Foreign Application Priority Data

Aug. 2, 2006 (JP) ..... 2006-210620

(51) Int. Cl.
*G09G 3/30* (2006.01)

(52) U.S. Cl. ..... 345/78; 345/76

(58) Field of Classification Search ..... 345/76, 345/78, 82, 87, 204; 315/169.3; 313/483
See application file for complete search history.

(56) References Cited

U.S. PATENT DOCUMENTS 7,532,207 B2 * 5/2009 Kawasaki et al. ..... 345/204
2006/0170628 A1 * 8/2006 Yamashita et al. ..... 345/76

FOREIGN PATENT DOCUMENTS

JP 2004-361640 12/2004

* cited by examiner

*Primary Examiner*—Ricardo L Osorio
(74) *Attorney, Agent, or Firm*—Rader, Fishman & Grauer PLLC

(57) ABSTRACT

A display apparatus includes: a pixel array section and dependence cancellation means. The pixel array section wherein a plurality of pixel circuits each including an electro-optical element, a driving transistor configured to drive said electro-optical element, a sampling transistor configured to sample and write an input signal voltage and a capacitor configured to hold a gate-source voltage of said driving transistor within a display period are disposed in a matrix. The dependence cancellation means for negatively feeding back, within a correction period before said electro-optical element emits light in a state wherein the input signal voltage is written by said sampling transistor, drain-source current of said driving transistor to the gate input side of said driving transistor to cancel the dependence of the drain-source current of said driving transistor on the mobility.

10 Claims, 18 Drawing Sheets t (WHITE) : t (GRAY) = 1/Vdata (WHITE) : 1/Vdata (GRAY)

DISPLAY APPARATUS AND DRIVING METHOD FOR DISPLAY APPARATUS

CROSS REFERENCES TO RELATED APPLICATIONS

The present invention contains subject matter related to Japanese Patent Application JP 2006-210620 filed with the Japan Patent Office on Aug. 2, 2006, the entire contents of which being incorporated herein by reference.

BACKGROUND OF THE INVENTION

1. Field of the Invention

This invention relates to a display apparatus and a driving method for a display apparatus, and more particularly to a display apparatus wherein a plurality of pixel circuits each including an electro-optical element are disposed in a matrix and a driving method for the display apparatus.

2. Description of the Related Art

In recent years, in the field of image display apparatus, an organic EL (electroluminescence) display apparatus has been developed and commercialized wherein a large number of pixel circuits each including an electro-optical element of the current driven type whose light emission luminance varies in response to the value of current flowing therethrough such as, for example, an organic EL element as a light emitting element of the pixel are disposed in a matrix. Since the organic EL element is a self-luminous element, the organic EL display apparatus is advantageous in that the observability of an image displayed is high, that no backlight is necessary and that the responding speed of the element is high when compared with a liquid crystal display apparatus wherein the light intensity from a light source (backlight) is controlled by a pixel circuit including a liquid crystal cell.

The organic EL display apparatus can adopt a simple (passive) matrix type or an active matrix type as a driving method therefor similarly to the liquid crystal display apparatus. However, although the display apparatus of the simple matrix type is simple in structure, it has such a problem that it is difficult to implement a display apparatus of a large size having high definition. Therefore, in recent years, efforts have been made to develop a display apparatus of the active matrix type wherein current to flow through a light emitting element is controlled by an active element provided in a pixel circuit in which the light emitting element is provided such as, for example, an insulated gate type field effect transistor (generally a thin film transistor (TFT)).

If it is possible to use, in a pixel circuit in which a thin film transistor (hereinafter referred to as "TFT") is used as an active element, an N-channel type transistor for the TFT, then it is possible to use an amorphous silicon (a-Si) process in related art in formation of the TFT on a substrate. The use of the a-Si process makes it possible to achieve reduction of the cost of the substrate on which the TFT is to be formed.

Incidentally, the current-voltage (I-V) characteristic of an organic EL element generally deteriorates as time passes (aged deterioration). Since, in a pixel circuit in which an N-channel TFT is used, the organic EL element is connected to the source side of a transistor (hereinafter referred to as "driving transistor") for driving the organic EL element with current, if the I-V characteristic of the organic EL element undergoes aged deterioration, then the gate-source voltage Vgs of the driving transistor changes. As a result, also the light emission luminance of the organic EL element changes.

This is described more particularly. The source potential of the driving transistor depends upon the operation point of the driving transistor and the organic EL element. If the I-V characteristic of the organic EL element deteriorates, then the operation point of the driving transistor and the organic EL element varies, and consequently, even if the same voltage is applied to the gate of the driving transistor, the source potential of the driving transistor changes. Consequently, the source-gate voltage Vgs of the driving transistor changes and the value of current flowing through the driving transistor changes. As a result, also the value of current flowing through the organic EL element changes, resulting in change of the light emission luminance of the organic EL element.

Further, in a pixel circuit which uses a polycrystalline TFT, the threshold voltage Vth of the driving transistor exhibits aged deterioration or differs among different pixels (individual transistors disperse in characteristic) in addition to the aged deterioration of the I-V characteristic of the organic EL element. Since, if the threshold voltage Vth is different among different driving transistors, then the values of current flowing through the driving transistors exhibit dispersion, even if the same voltage is applied to the gate of the driving transistors, the organic EL elements emit light in different luminance, resulting in loss of the uniformity of the screen.

In the past, in order to keep the light emission luminance of the organic EL element fixed without being influenced by aged deterioration of the I-V characteristic of the organic EL element or by aged deterioration of the threshold voltage Vth of the driving transistor even if such aged deterioration or change occurs, a compensation function against the characteristic variation of the organic EL element and a compensation function against the variation of the threshold voltage Vth of the driving transistor are provided for each pixel circuit. The configuration just described is disclosed, for example, in Japanese Patent Laid-Open No. 2004-361640.

SUMMARY OF THE INVENTION

However, where a polycrystalline silicon TFT is used in pixel circuits, also the mobility μ of carriers of the driving transistor differs among different pixels in addition to aged deterioration of the I-V characteristic of the organic EL element, aged deterioration of the threshold voltage Vth of the driving transistor and dispersion among the pixels.

Since the driving transistor is designed so as to operate in a saturation region, it acts as a constant current source. As a result, fixed drain-source current Ids given by the following expression (1) is supplied from the driving transistor to the organic EL element:

$$Ids=(1/2)\cdot\mu(W/L)Cox(Vgs-Vth)^2 \quad (1)$$

where Vth is the threshold voltage of the driving TFT, μ the mobility of the carriers, W the channel width, L the channel length, Cox the gate capacitance per unit area, and Vgs the gate-source voltage.

As can be seen apparently from the expression (1) above, if the mobility μ differs among different pixels, since dispersion in the drain-source voltage Ids flowing through the driving transistor appears among the pixels, the light emission luminance of the organic EL element differs among the pixels. As a result, the resulting display screen exhibits ununiform picture quality including stripes or irregular or ununiform luminance.

Therefore, it is demanded to provide a display apparatus and a driving method therefor wherein a correction function against dispersion of the mobility of a driving transistor among pixels is implemented with low power consumption to obtain a display image of uniform picture quality free from strips or luminance ununiformity.

According to an embodiment of the present invention, there is provided a display apparatus including a pixel array section and a dependence cancellation section. The pixel array section wherein a plurality of pixel circuits each including an electro-optical element, a driving transistor, a sampling transistor, and a capacitor are disposed in a matrix. The driving transistor is configured to drive the electro-optical element. The sampling transistor is configured to sample and write an input signal voltage. The capacitor is configured to hold a gate-source voltage of the driving transistor within a display period. The dependence cancellation section is configured to negatively feed back, within a correction period before the electro-optical element emits light in a state wherein the input signal voltage is written by the sampling transistor, drain-source current of the driving transistor to the gate input side of the driving transistor to cancel the dependence of the drain-source current of the driving transistor on the mobility. The time of the correction period is set so as to increase in inverse proportion to the gate-source voltage–threshold voltage of the driving transistor prior to the correction period.

In the display apparatus, since the drain-source current of the driving transistor is negatively fed back to the gate input side of the driving transistor, the current value of the drain-source current is uniformized among the pixels which are different in mobility. As a result, correction of the mobility against dispersion is achieved. The feedback amount in the negative feedback can be optimized by adjusting the correction time for the mobility. The optimum mobility correction time decreases as the input signal voltage increases. In other words, the optimum mobility correction time and the input signal voltage have an inverse proportional relationship to each other. Accordingly, by setting the mobility correction time in inverse proportion to the input signal voltage, the dependence of the drain-source current of the driving transistor upon the mobility can be canceled with certainty over an overall level range of the input signal voltage from the black level to the white level.

With the display apparatus, since the dependence of the drain-source current of the driving transistor upon the mobility can be canceled over an overall level range or over all gradations of the input signal voltage from the black level to the white level, a display image of uniform picture quality free from a stripe or uneven luminance arising from the fact that the mobility of the driving transistor differs among the different pixels can be obtained.

DETAILED DESCRIPTION OF THE PREFERRED EMBODIMENTS

Figure 1:
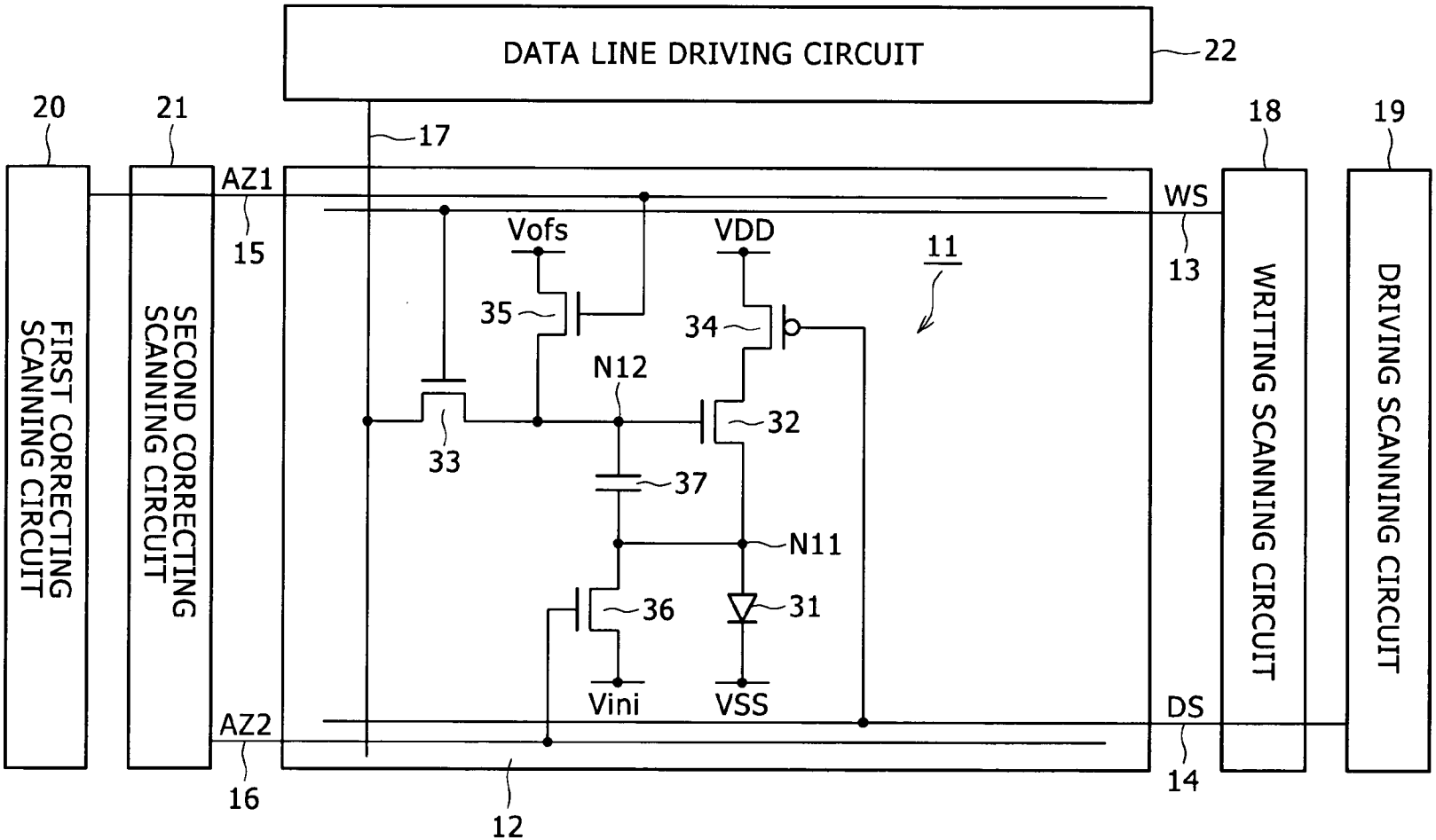
FIG. 1 is a circuit diagram showing a configuration of an active matrix display apparatus to which an embodiment of the present invention is applied and a pixel circuit used in the display apparatus.

Embodiments of the present invention will be described in detail below, referring to the drawings.

FIG. 1 shows a configuration of an active matrix display apparatus to which an embodiment of the present invention is applied and a pixel circuit used in the display apparatus.

(Pixel Array Section)

Referring to FIG. 1, the active matrix type organic EL display apparatus according to the embodiment of the present embodiment includes a pixel array section 12 wherein a plurality of pixel circuits 11 each including, as a light emitting element of a pixel, an electro-optical element of the current driven type whose light emission luminance varies in response to the value of current flowing therethrough such as, for example, an organic EL element 31 are disposed two-dimensionally in a matrix. In FIG. 1, for the simplified illustration, a particular circuit configuration of one of the pixel circuits 11 is shown.

In the pixel array section 12, for each of the pixel circuits 11, a scanning line 13, a driving line 14 and first and second correcting scanning lines 15 and 16 are wired for each pixel row, and a data line or signal line 17 is wired for each pixel column. Around the pixel array section 12, a writing scanning circuit 18 for driving and scanning the scanning lines 13, a driving scanning circuit 19 for driving and scanning the driving lines 14, first and second correcting scanning circuits 20 and 21 for driving and scanning the first and second correcting scanning lines 15 and 16, respectively, and a data line driving circuit 22 for supplying a data signal or image signal in accordance with luminance information to the data lines 17 are disposed.

In the active matrix type organic EL display apparatus shown in FIG. 1, the writing scanning circuit 18 and the driving scanning circuit 19 are disposed one side, on the right side in FIG. 1, with respect to the pixel array section 12, and the first and second correcting scanning circuits 20 and 21 are disposed on the opposite side. However, the components mentioned are not disposed restrictively in the arrangement relationship described but may be disposed in a different scheme. The writing scanning circuit 18, driving scanning circuit 19 and first and second correcting scanning circuits 20 and 21 suitably output a writing signal WS, a driving signal DS and first and second correcting scanning signals AZ1 and AZ2 in order to drive and scan the scanning lines 13, driving lines 14 and first and second correcting scanning lines 15 and 16, respectively.

The pixel array section 12 is normally formed on a transparent insulating substrate such as a glass substrate and has a planar or flat type panel structure. Each of the pixel circuits 11 of the pixel array section 12 can be formed using an amorphous silicon TFT (thin film transistor) or a low temperature polycrystalline silicon TFT. In the present embodiment described below, the pixel circuit 11 is formed using a low temperature polycrystalline silicon TFT. Where a low temperature polycrystalline silicon TFT is used, also the writing scanning circuit 18, driving scanning circuit 19, first and second correcting scanning circuits 20 and 21 and data line driving circuit 22 can be formed integrally on a panel which forms the pixel circuit 11.

(Pixel Circuit)

The pixel circuit 11 has a circuit configuration which includes, as components thereof, a driving transistor 32, a sampling transistor 33, switching transistors 34 to 36, and a capacitor (pixel capacitance/holding capacitance) 37 in addition to an organic EL element 31.

In the pixel circuit 11, an N-channel TFT is used for the driving transistor 32, sampling transistor 33 and switching transistors 35 and 36 while a P-channel TFT is used for the switching transistor 34. However, the combination of the conduction types of the driving transistor 32, sampling transistor 33 and switching transistors 34 to 36 is a mere example and is not used restrictively.

The organic EL element 31 is connected at the cathode electrode thereof to a first power supply potential VSS which is, in the arrangement shown in FIG. 1, the ground potential GND. The driving transistor 32 is provided to drive the organic EL element 31 with current and is connected at the source thereof to the anode electrode of the organic EL element 31 to form a source follower circuit. The sampling transistor 33 is connected at the source thereof to the data line 17, at the drain thereof to the gate of the driving transistor 32 and at the gate thereof to the scanning line 13.

The switching transistor 34 is connected at the source thereof to a second power supply potential VDD which is, in the arrangement shown in FIG. 1, a positive power supply potential, at the drain thereof to the drain of the driving transistor 32, and at the gate thereof to the driving line 14. The switching transistor 35 is connected at the drain thereof to a third power supply potential Vofs, at the source thereof to the drain of the sampling transistor 33 and gate of the driving transistor 32 and at the gate thereof to the first correcting scanning line 15.

The switching transistor 36 is connected at the drain thereof to a node N11 between the source of the driving transistor 32 and the anode electrode of the organic EL element 31, at the source thereof to a fourth power supply potential Vini, which is, in the arrangement shown in FIG. 1, a negative power supply potential, and at the gate thereof to the second correcting scanning line 16. The capacitor 37 is connected at one terminal thereof to a node N12 between the gate of the driving transistor 32 and the drain of the sampling transistor 33 and at the other end thereof to the node N11 between the source of the driving transistor 32 and the anode electrode of the organic EL element 31.

In the pixel circuit 11 in which the components described above are connected in the connection scheme described above, the components operate in the following manner. In particular, when the sampling transistor 33 is placed into conducting state, it samples an input signal voltage Vsig (=Vofs+Vdata; Vdata>0) supplied thereto through the data line 17. The sampled input signal voltage Vsig is held into the capacitor 37. The switching transistor 34 supplies, when it is in a conducting state, current from the second power supply potential VDD to the driving transistor 32.

The driving transistor 32 supplies, when the switching transistor 34 is in a conducting state, current of a value based on the input signal voltage Vsig held in the capacitor 37 to the organic EL element 31 to drive the organic EL element 31 (current driving). The switching transistors 35 and 36 detect, when they are placed suitably into a conducting state, a threshold voltage Vth32 of the driving transistor 32 prior to current driving of the organic EL element 31 and holds the detected threshold voltage Vth32 into the capacitor 37 in order to cancel the influence of the threshold voltage Vth32. The capacitor 37 holds the gate-source voltage of the driving transistor 32 over a display period.

In the pixel circuit 11, the fourth power supply potential Vini is set so as to be lower than the potential difference of the threshold voltage Vth32 of the driving transistor 32 from the third power supply potential Vofs as a condition for assuring normal operation. In particular, the fourth power supply potential Vini, third power supply potential Vofs and threshold voltage Vth32 have a level relationship of Vini<Vofs−Vth32. Further, the level of the sum of the cathode potential Vcat of the organic EL element 31, which his, in the in the arrangement shown in FIG. 1, the ground potential GND, and the threshold voltage Vthel of the organic EL element 31 is set so as to be higher than the level of the difference of the threshold voltage Vth32 of the driving transistor 32 from the third power supply potential Vofs. In other words, the cathode potential Vcat, threshold voltage Vthel, third power supply potential Vofs and threshold voltage Vth32 have a level relationship of Vcat+Vthel>Vofs−Vth32 (>Vini).

It is to be noted that, since the pixel circuit 11 described above does not have a period within which the writing signal WS and the first correcting scanning signal AZ1 exhibits the "H" level at the same time, it is possible to use the switching transistor 35 commonly as the sampling transistor 33 and use the power supply line of the third power supply potential Vofs commonly as the data line 17 (signal line). In this instance, the third power supply potential Vofs may be supplied within a period within which the first correcting scanning signal AZ1 has the "H" level whereas the input signal voltage Vsig is supplied within another period within which the writing signal WS has the "H" level, from the data line 17.

[Circuit Operation]

Now, circuit operation of the active matrix type organic EL display apparatus wherein a plurality of pixel circuits 11 having the configuration described above are disposed two-dimensionally is described with reference to FIG. 2. In the timing waveform diagram of FIG. 2, a period from time t1 to time t9 is defined as one field period. The pixel rows of the pixel array section 12 are successively scanned once within this one field period.

Figure 2:
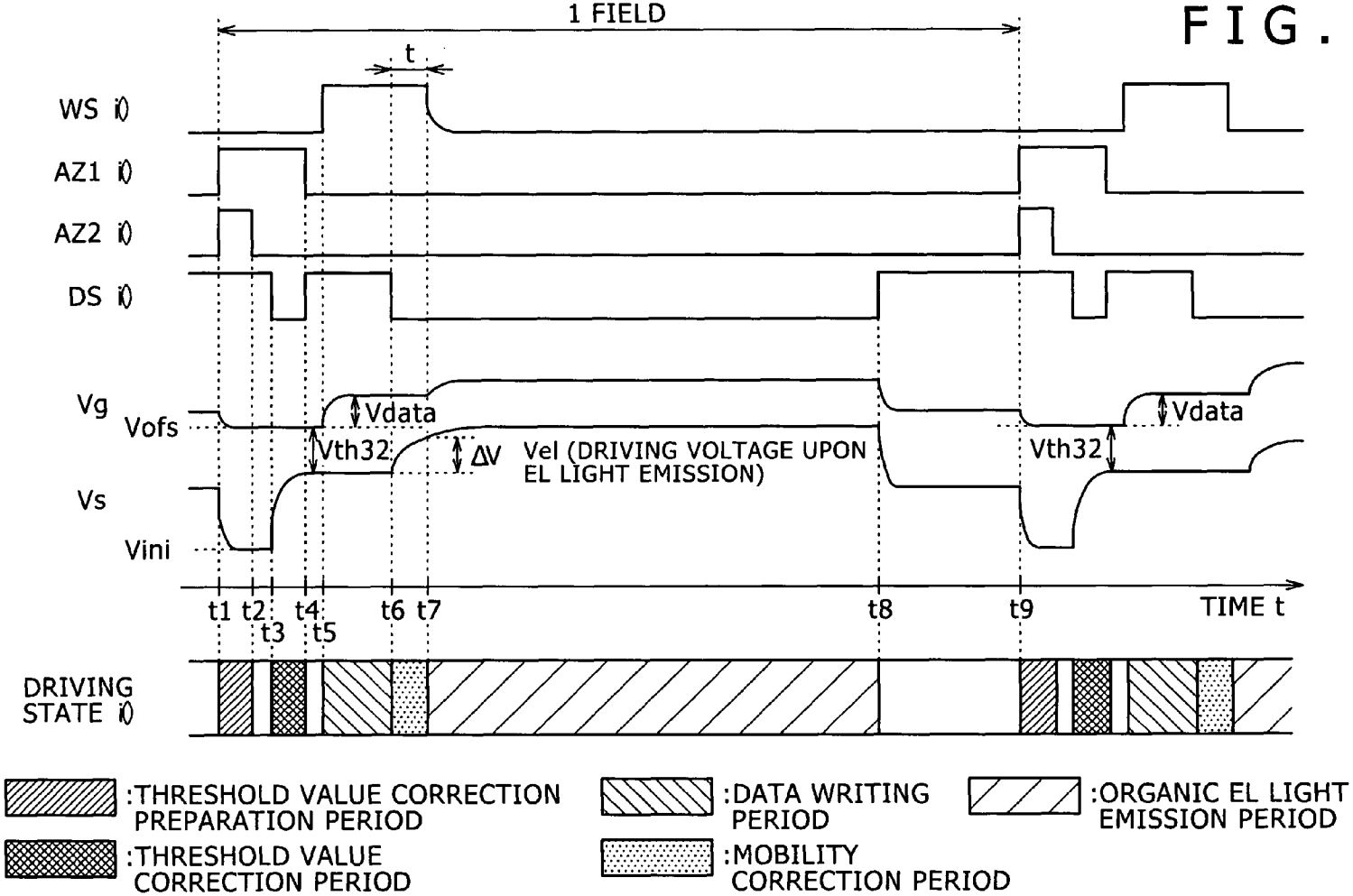
FIG. 2 is a timing waveform diagram illustrating a timing relationship among a writing signal, a driving signal and first and second correcting scanning signals and a variation of the gate potential and the source potential of a driving transistor.

FIG. 2 illustrates a timing relationship of the writing signal WS provided from the writing scanning circuit 18 to the pixel circuits 11 in a certain ith row through the scanning line 13 and the driving signal DS provided from the driving scanning circuit 19 to the pixel circuits 11 through the driving line 14. FIG. 2 further illustrates the timing relationship of and the first and second correcting scanning signals AZ1 and AZ2 provided from the first and second correcting scanning circuits 20 and 21 to the pixel circuits 11 through the first and second correcting scanning lines 15 and 16 and a variation of the gate potential Vg and the source potential Vs of the driving transistor 32.

Since the sampling transistor 33 and the switching transistors 35 and 36 are of the N-channel type, the state wherein the writing signal WS and the first and second correcting scanning signals AZ1 and AZ2 exhibit the high level (in the present example, the power supply potential VDD; hereinafter referred to as "H" level) is referred to as an active state. On the other hand, the state wherein the writing signal WS and the first and second correcting scanning signals AZ1 and AZ2 exhibit the low level (in the present example, the power supply potential VSS (ground level); hereinafter referred to as "L" level) is referred to as an inactive state. Further, since the switching transistor 34 is of the P-channel type, the state wherein the driving signal DS exhibits the "L" level is referred to as active state, and the state wherein the driving signal DS exhibits the "H" level is referred to as inactive state.

(Light Emission Period)

First, within an ordinary light emission period (t7 to t8), all of the writing signal WS outputted from the writing scanning circuit 18, the driving signal DS outputted from the driving scanning circuit 19 and the first and second correcting scanning signals AZ1 and AZ2 outputted from the first and second correcting scanning circuits 20 and 21, respectively, exhibit the "L" level. Therefore, the sampling transistor 33 and the switching transistors 35 and 36 are in a non-conducting (off) state while the switching transistor 34 is in a conducting (on) state.

At this time, the driving transistor 32 acts as a constant current source since it is designed so as to operate within a saturation region. As a result, fixed drain-source current Ids defined as hereinabove by the expression (1) is supplied from the driving transistor 32 to the organic EL element 31 through the switching transistor 34. Then, when the level of the driving signal DS changes from the "L" level to the "H" level at time t8, the switching transistor 34 is placed into a non-conducting state, and the current supply from the second power supply potential VDD to the driving transistor 32 is interrupted. Consequently, the light emission of the organic EL element 31 stops, and a no-light emission period is entered.

(Threshold Value Correction Preparation Period)

When the state of the first and second correcting scanning signals AZ1 and AZ2 outputted from the first and second correcting scanning circuits 20 and 21, respectively, changes from the "L" state to the "H" level at time t1 (t9) while the switching transistor 34 is in the non-conducting state, the switching transistors 35 and 36 are placed into a non-conducting state. Consequently, a threshold value correction preparation period for correcting the threshold voltage Vth32 of the driving transistor 32 hereinafter described to cancel the dispersion of the threshold voltage Vth32 is entered.

Whichever one of the switching transistors 35 and 36 may enter a conducting state first. After the switching transistors 35 and 36 are placed into a conducting state, the third power supply potential Vofs is applied to the gate of the driving transistor 32 through the switching transistor 35 while the fourth power supply potential Vini is applied to the source of the driving transistor 32 and anode electrode of the organic EL element 31 through the switching transistor 36.

At this time, since the level relationship of Vini<Vcat+Vthel is satisfied as described hereinabove, the organic EL element 31 is placed into a reversely biased state. Accordingly, no current flows through the organic EL element 31, and the organic EL element 31 is in a no-light emission state. Further, the gate-source voltage Vgs of the driving transistor 32 has the value of Vofs−Vini. Here, as described hereinabove, the level relationship of Vofs−Vini>Vth32 is satisfied.

When the level of the second correcting scanning signal AZ2 outputted from the second correcting scanning circuit 21 changes from the "H" level to the "L" level at time t2, the switching transistor 36 is placed into a non-conducting state, and the threshold value correction preparation period ends therewith.

(Threshold Value Correction Period)

Thereafter, the level of the driving signal DS outputted from the driving scanning circuit 19 changes from the "H" level to the "L" level at time t3 to place the switching transistor 34 into a conducting state. While the switching transistor 34 is in a conducting state, current flows along a path of the power supply potential VDD→switching transistor 34→node N11→capacitor 37→node N12→switching transistor 35→power supply potential Vofs.

Figure 3:
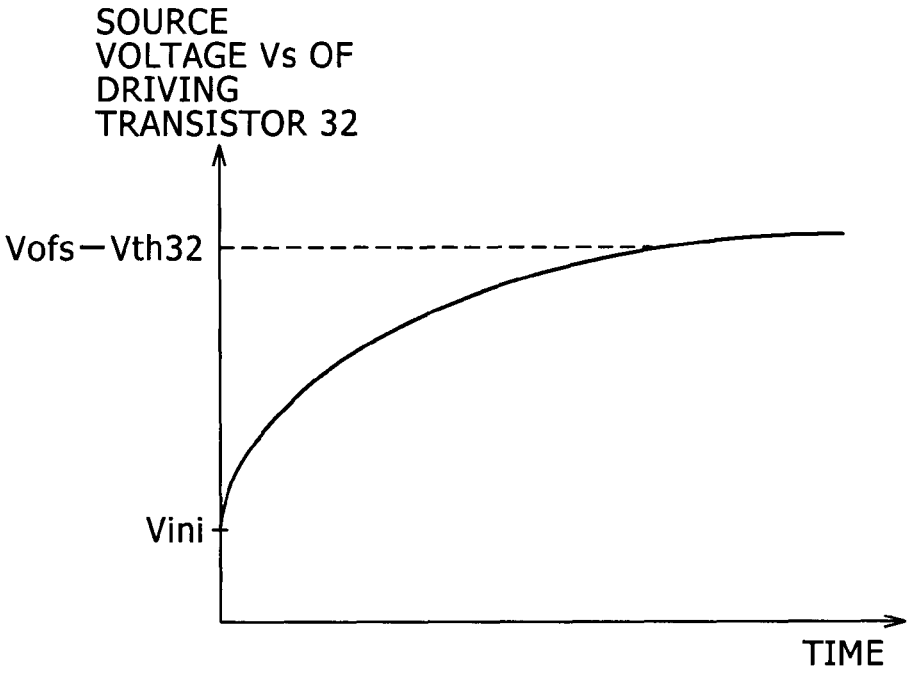
FIG. 3 is a characteristic diagram illustrating operation of the pixel circuit.

At this time, the gate potential Vg of the driving transistor 32 is held at the power supply potential Vofs, and current continues to flow along the path described above until after the driving transistor 32 is cut off (enters a non-conducting state from a conducting state). At this time, the potential at the node N11, that is, the source potential Vs at the driving transistor 32, gradually rises from the fourth power supply potential Vini as the time passes as seen from FIG. 3.

Then, when a fixed interval of time passes and the potential difference between the node N11 and the node N12, that is, the gate-source voltage Vgs of the driving transistor 32, becomes equal to the threshold voltage Vth32, the driving transistor 32 is cut off. The threshold voltage Vth32 between the nodes N11 and N12 is held as a potential for threshold value correction by the capacitor 37. At this time, a condition of Vel=Vofs−Vth32<Vcat+Vthel is satisfied.

Thereafter, the level of the driving signal DS outputted from the driving scanning circuit 19 changes from the "L" level to the "H" level and the level of the first correcting scanning signal AZ1 outputted from the first correcting scanning circuit 20 changes from the "H" level to the "L" level at time t4. Consequently, the switching transistors 34 and 35 are placed into a non-conducting state. The period from time t3 to time t4 is a period within which the threshold voltage Vth32 of the driving transistor 32 is detected. The detection period from time t3 to time t4 is hereinafter referred to as threshold value correction period.

When the switching transistors 34 and 35 are placed into a non-conducting state at time t4, the threshold value correction period ends. At this time, the switching transistor 34 is placed into a non-conducting state earlier than the switching transistor 35. Consequently, the variation of the gate potential Vg of the driving transistor 32 can be suppressed.

(Writing Period)

Thereafter, the level of the writing signal WS outputted from the writing scanning circuit 18 changes from the "L" level to the "H" level at time t5. Consequently, the sampling transistor 33 is placed into a conducting state and a writing period of the input signal voltage Vsig is started. Within the writing period, the input signal voltage Vsig is sampled by the sampling transistor 33 and written into the capacitor 37.

The organic EL element 31 has a capacitance component. Here, where the capacitance component of the driving transistor 32 is represented by Coled, the capacitance component of the capacitor 37 by Cs and the parasitic capacitance of the driving transistor 32 by Cp, the gate-source voltage Vgs of the driving transistor 32 is determined by the following expression (2):

$$Vgs=\{Coled/(Coled+Cs+Cp)\}\cdot(Vsig-Vofs)+Vth32 \quad (2)$$

Generally, the capacitance value Coled of the capacitance component of the organic EL element 31 is sufficiently high when compared with the capacitance value Cs of the capacitor 37 and the parasitic capacitance value Cp of the driving transistor 32. Accordingly, the gate-source voltage Vgs of the driving transistor 32 is substantially equal to (Vsig−Vofs)+Vth. Further, since the capacitance value Cs of the capacitor 37 is sufficiently low when compared with the capacitance value Coled of the capacitance component of the organic EL element 31, most part of the input signal voltage Vsig is written into the capacitor 37. More accurately, the difference Vsig−Vofs between the input signal voltage Vsig and the source potential Vs of the driving transistor 32, that is, the power supply potential Vofs, is written as an effective input signal voltage Vdata.

The effective input signal voltage Vdata (=Vsig−Vofs) is held by the capacitor 37 in such a form that it is added to the threshold voltage Vth32 held in the capacitor 37. In other words, the held voltage of the capacitor 37, that is, the gate-source voltage Vgs of the driving transistor 32, is Vsig−Vofs+Vth32. If it is assumed that the third power supply potential Vofs is Vofs=0 V for simplified description in the following, then the gate-source voltage Vgs is given by Vsig+Vth32. In this manner, by holding the threshold voltage Vth32 in advance in the capacitor 37, correction for dispersion of the threshold voltage Vth32 or aged deterioration can be performed as hereinafter described.

In particular, where the threshold voltage Vth32 is held in advance in the capacitor 37, upon driving of the driving transistor 32 with the input signal voltage Vsig, the threshold voltage Vth32 of the driving transistor 32 is canceled by the threshold voltage Vth32 held in the capacitor 37. In other words, since correction of the threshold voltage Vth32 is performed, even if the threshold voltage Vth32 suffers from dispersion or aged deterioration, the light emission luminance of the organic EL element 31 can be kept fixed without being influenced by such dispersion and aged deterioration.

(Mobility Correction Period)

When the level of the driving signal DS outputted from the driving scanning circuit 19 changes from the "H" level to the "L" level to place the switching transistor 34 into a conducting state while the writing signal WS is in the "H" level state, the data writing period ends, and a mobility correction period within which correction for dispersion of the mobility μ of the driving transistor 32 is to be performed is entered. Within the mobility correction period, an active period ("H" level period) of the writing signal WS and an active period ("L" level period) of the driving signal DS overlap with each other.

Since the switching transistor 34 is placed into a conductive state to start current supply from the power supply potential VDD to the driving transistor 32, the pixel circuit 11 enters a light emission period from a no-light emission period. Within a period within which the sampling transistor 33 still remains in a conducting state in this manner, that is, within a period from time t6 to time t7 within which a trailing portion of a sampling period and a leading portion of a light emitting period overlap with each other, mobility correction of canceling the dependence of the drain-source current Ids of the driving transistor 32 upon the drain-source current Ids is performed.

It is to be noted that, within the top portion t6 to t7 of the light emission period within which the mobility correction is performed, the drain-source current Ids flows through the driving transistor 32 in a state wherein the gate potential Vg of the driving transistor 32 is fixed to the input signal voltage Vsig. Here, since the setting of Vofs−Vth32<Vthel is used, the organic EL element 31 is placed in a reversely biased state, and therefore, even if the pixel circuit 11 enters a light emission period, the organic EL element 31 emits no light.

Within the mobility correction period t6 to t7, since the organic EL element 31 is in a reversely biased state, the organic EL element 31 exhibits not a diode characteristic but a simple capacitive characteristic. Accordingly, the drain-source current Ids flowing through the driving transistor 32 is written into the composite capacitance C (=Cs+Coled) of the capacitance value Cs of the capacitor 37 and the capacitance value Coled of the capacitance component of the organic EL element 31. As a result of the writing, the source potential Vs of the driving transistor 32 rises. In the timing chart of FIG. 2, an increment of the source potential Vs is represented by ΔV.

The increment ΔV of the source potential Vs after all acts so as to be subtracted from the gate-source voltage Vgs of the driving transistor 32 held in the capacitor 37, that is, so as to discharge the accumulated charge of the capacitor 37, and therefore, this is equivalent to application of negative feedback. In other words, the increment ΔV of the source potential Vs is a feedback amount in the negative feedback. In this instance, the gate-source voltage Vgs is given by Vsig−ΔV+Vth32. Where the drain-source current Ids flowing through the driving transistor 32 is applied as a gate input to the driving transistor 32, that is, negatively fed back to the gate-source voltage Vgs, the dispersion of the mobility μ of the driving transistor 32 can be corrected.

(Light Emission Period)

Thereafter, when the level of the writing signal WS outputted from the writing scanning circuit 18 changes to the "L" level and the sampling transistor 33 is placed into a non-conducting state at time t7, the mobility correction period ends and a light emission period is started. As a result, the gate of the driving transistor 32 is disconnected from the data line 17 to cancel the application of the input signal voltage Vsig, and consequently, the gate potential Vg of the driving transistor 32 is permitted to rise and thereafter rises together with the source potential Vs. Meanwhile, the gate-source voltage Vgs held in the capacitor 37 keeps the value of Vsig−ΔV+Vth32.

Then, as the source potential Vs of the driving transistor 32 rises, the reversely biased state of the organic EL element 31 is canceled soon, and consequently, the drain-source current Ids from the driving transistor 32 flows into the organic EL element 31 so that the organic EL element 31 actually starts light emission.

The relationship between the drain-source current Ids and the gate-source voltage Vgs in this instance is given, by substituting Vsig−ΔV+Vth32 into Vgs of the expression (1) given hereinabove, the following expression (3) is given:

$$Ids=k\mu(Vgs-Vth32)^2=k\mu(Vsig-V)^2 \quad (3)$$

where k=(½)(W/L)Cox.

As can be seen apparently from the expression (3) above, the term of the threshold voltage Vth32 of the driving transistor 32 is canceled, and the drain-source current Ids supplied from the driving transistor 32 to the organic EL element 31 does not depend upon the threshold voltage Vth32 of the driving transistor 32. Basically, the drain-source current Ids depends upon the input signal voltage Vsig. In other words, the organic EL element 31 emits light with a luminance which depends upon the input signal voltage Vsig without being influenced by dispersion or aged deterioration of the threshold voltage Vth32 of the driving transistor 32.

Further, as can be seen apparently from the expression (3) given hereinabove, the input signal voltage Vsig is corrected with the feedback amount ΔV by the negative feedback of the drain-source current Ids to the gate input of the driving transistor 32. The feedback amount ΔV acts to cancel the effect of the mobility μ positioned at the coefficient part of the expression (3). Accordingly, the drain-source current Ids substantially depends only upon the input signal voltage Vsig. In other words, the organic EL element 31 emits light with a luminance which depends upon the input signal voltage Vsig without being influenced not only by the threshold voltage Vth32 of the driving transistor 32 but also by the dispersion or the aged deterioration of the mobility μ of the driving transistor 32. As a result, uniform picture quality free from a stripe or uneven luminance.

Finally, the level of the driving signal DS outputted from the driving scanning circuit 19 changes from the "L" level to the "H" level to place the switching transistor 34 into a non-conducting state. Consequently, the current supply from the second power supply potential VDD to the driving transistor 32 is interrupted thereby to end the light emission period. Thereafter, processing for a next field is started at time t9 (t1) so that the series of operation of the threshold value correction, mobility correction and light mission operation is executed repetitively.

Here, in some other active matrix type display apparatus wherein the pixel circuits 11 each including an organic EL element 31 which is an electro-optical element of the current driven type are disposed in a matrix, if the light emission period of the organic EL element 31 becomes long, then the I-V characteristic of the organic EL element 31 varies. Therefore, also the potential at the node N11 between the anode electrode of the organic EL element 31 and the source of the driving transistor 32 varies.

On the other hand, in the active matrix type display apparatus according to the present embodiment, since the gate-source voltage Vgs of the driving transistor 32 is kept at a fixed value, the current to flow through the organic EL element 31 does not vary. Accordingly, even if the I-V characteristic of the organic EL element 31 becomes deteriorated, the fixed drain-source current Ids continues to flow through the organic EL element 31, and consequently, the light emission luminance of the organic EL element 31 does not vary (compensation function for characteristic variation of the organic EL element 31).

Further, since the threshold voltage Vth32 of the driving transistor 32 is held into the capacitor 37 in advance before the input signal voltage Vsig is written, the threshold voltage Vth32 of the driving transistor 32 is canceled (corrected) so that the fixed drain-source current Ids which is not influenced by the dispersion or the aged deterioration of the threshold voltage Vth can be supplied to the organic EL element 31. Therefore, a display image of high picture quality can be obtained (compensation function for the threshold value voltage variation of the driving transistor 32).

Further, within the mobility correction period t6 to t7, the drain-source current Ids is negatively fed back to the gate input of the driving transistor 32 so that the input signal voltage Vsig is corrected with the feedback amount ΔV. Consequently, the dependence of the drain-source current Ids of the driving transistor 32 upon the mobility μ can be canceled, and the drain-source current Ids which depends only upon the input signal voltage Vsig can be supplied to the organic EL element 31. Therefore, a display image of uniform picture quality free from a stripe or uneven luminance which arises from dispersion or aged deterioration of the mobility μ of the driving transistor 32 can be obtained (compensation function for the mobility μ of the driving transistor 32).

[Mobility Correction]

Here, the compensation function for the mobility μ of the driving transistor 32 is studied. The feedback amount ΔV in the negative feedback of the drain-source current Ids to the gate input of the driving transistor 32 can be optimized by adjusting the time width t of the mobility correction period t6 to t7.

Figure 4:
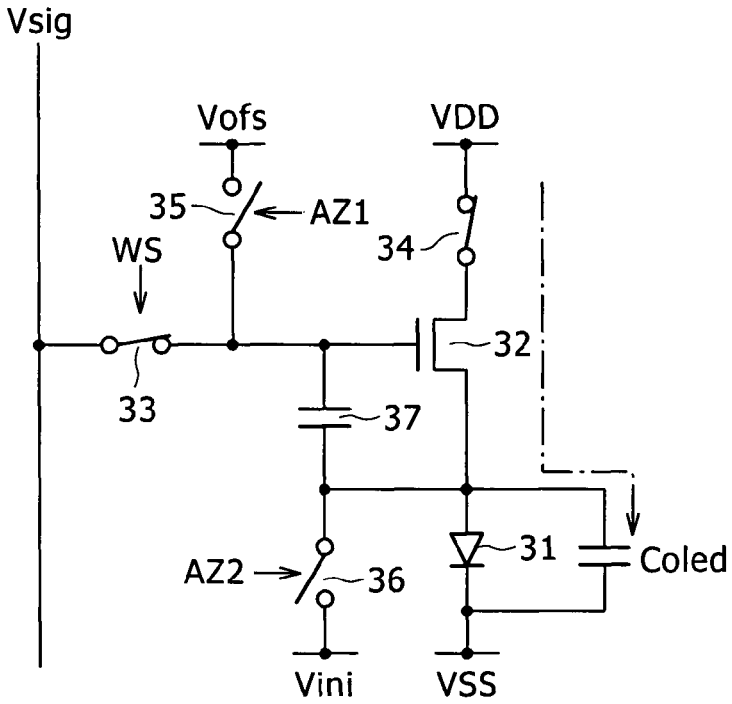
FIG. 4 is a circuit diagram illustrating a state of the pixel circuit within a mobility correction period.

FIG. 4 illustrates a state of the pixel circuit 11 within the mobility correction period t6 to t7. In FIG. 4, the sampling transistor 33 and the switching transistors 34 to 36 are shown using a symbol of a switch for the simplified illustration.

Referring to FIG. 4, within the mobility correction period t6 to t7, the sampling transistor 33 and the switching transistor 34 are in a conducting state (the writing signal WS and the driving signal DS are in an active state). Meanwhile, the switching transistors 35 and 36 are in a non-conducting state (the first and second correcting scanning signals AZ1 and AZ2 are in an inactive state) and the gate potential Vg of the driving transistor 32 is fixed to the input signal voltage Vsig. In this state, the drain-source current Ids flows through the driving transistor 32.

Here, where the setting of Vofs−Vth32<Vthel is applied as described above, the organic EL element 31 is placed in a reversely biased state and hence indicates not a diode characteristic but a simple capacitive characteristic. Accordingly, the drain-source current Ids flowing through the driving transistor 32 flows into the composite capacitance C (=Cs+Coled) of the capacitor 37 and the equivalent capacitance of the organic EL element 31. In other words, part of the drain-source current Ids is negatively fed back to the capacitor 37, and as a result, correction of the mobility μ of the driving transistor 32 is performed.

Figure 5:
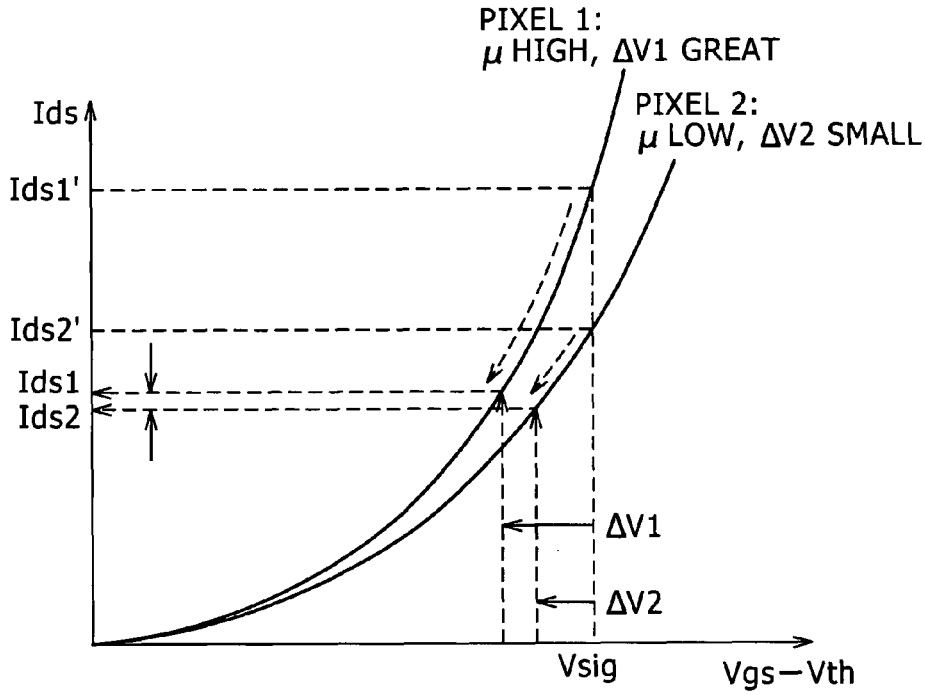
FIG. 5 is a diagram illustrating a relation between an input signal voltage and drain-source current of a pixel having a comparatively high mobility and another pixel having a comparatively low mobility.

FIG. 5 illustrates a graph of the expression (3) which is a relationship expression of the drain-source current Ids and the gate-source voltage Vgs. The axis of ordinate indicates the drain-source current Ids, and the axis of abscissa indicates the input signal voltage Vsig.

The graph shown in FIG. 5 indicates characteristic curves for comparison of a pixel 1 whose driving transistor 32 has a comparatively high mobility μ and another pixel 2 whose driving transistor 32 has a comparatively low mobility μ. Where the driving transistors 32 are each formed from a polycrystalline silicon thin film transistor or the like, it is difficult to avoid that the mobility μ disperses between different pixels like between the pixel 1 and the pixel 2.

For example, if the image signals Vsig of an equal level are individually written into the pixels 1 and 2 in a state wherein the mobility μ disperses between the pixel 1 and the pixel 2, then if no correction for the mobility is performed, then a great difference will appear between drain-source current Ids1' flowing to the pixel 1 having the high mobility μ and drain-source current Ids2' flowing to the pixel 2 having the low mobility μ. If a great difference arises in the drain-source current Ids1 between different pixels from dispersion of the mobility μ in this manner, then this damages the uniformity of the screen.

Therefore, according to the embodiment of the present invention, a compensation function of canceling (compensating against) the dispersion of the mobility μ of the driving transistor 32 among the pixels is achieved by negatively feeding back the drain-source current Ids of the driving transistor 32 to the input signal voltage Vsig side. As apparent from the transistor characteristic expression given as the expression (1) hereinabove, as the mobility μ increases, the drain-source current Ids increases. Accordingly, the feedback amount ΔV in the negative feedback increases as the mobility μ increases.

As seen from the graph of FIG. 5, the feedback amount ΔV1 in the pixel 1 having the high mobility μ is greater than the feedback amount ΔV2 in the pixel 2 having the low mobility μ. Accordingly, since the negative feedback amount increases as the mobility μ increases, the dispersion of the mobility μ can be suppressed. More particularly, if correction of the feedback amount ΔV1 is applied to the pixel 1 having the high mobility μ, then the drain-source current Ids decreases by a great amount from Ids1' to Ids1.

On the other hand, since the correction amount which is the feedback amount ΔV2 in the pixel 2 having the low mobility μ is small, the drain-source current Ids decreases from Ids2' to Ids2 and does not decrease by a very great amount. As a result, the drain-source current Ids1 in the pixel 1 and the drain-source current Ids2 in the pixel 2 become substantially equal to each other, and consequently, the dispersion of the mobility μ is canceled. Since the correction against the dispersion of the mobility μ is performed over an overall level range of the input signal voltage Vsig from the black level to the white level, the uniformity of the screen is enhanced significantly.

In summary, where a pixel 1 and another pixel 2 are different in mobility μ from each other, the feedback amount ΔV1 in the pixel 1 whose mobility μ is high is smaller than the feedback amount ΔV2 in the pixel 2 whose mobility μ is low. In other words, a pixel having a higher mobility μ involves a greater feedback amount ΔV and exhibits a greater decreasing amount of the drain-source current Ids. Thus, by negatively feeding back the drain-source current Ids of the driving transistor 32 to the input signal voltage Vsig side, the current value of the drain-source current Ids is uniformized among pixels which are different in mobility μ, and as a result, the mobility μ can be corrected against dispersion.

Here, a numerical analysis of the mobility correction described above is performed. If it is assumed that an analysis is performed using the source potential Vs of the driving transistor 32 as a variable V in a state wherein the sampling transistor 33 and the switching transistor 34 are in a conducting state as seen in FIG. 4, then the drain-source current Ids given by the following expression (4) flows through the driving transistor 32:

$$Ids = k\mu(Vgs - Vth32)^2 = k\mu(Vsig - V - Vth32)^2 \quad (4)$$

Meanwhile, from the relationship between the drain-source current Ids and the capacitance C (=Cs+Coled), Ids=dQ/dt=CdV/dt is satisfied as recognized from the following expression (5). It is to be noted that, in the expression (5), Vth32 is represented as Vth.

From $$Ids = \frac{dQ}{dt} = C\frac{dV}{dt},\ \int \frac{1}{C}dt = \int \frac{1}{Ids}dV \quad (5)$$

$$\Leftrightarrow \int_0^t \frac{1}{C}dt = \int_{-Vth}^{V} \frac{1}{k\mu(Vsig - Vth - V)^2}dV$$

$$\Leftrightarrow \frac{k\mu}{C}t = \left[\frac{1}{Vsig - Vth - V}\right]_{-Vth}^{V} = \frac{1}{Vsig - Vth - V} - \frac{1}{Vsig}$$

$$\Leftrightarrow Vsig - Vth - V = \frac{1}{\frac{1}{Vsig} + \frac{k\mu}{C}t} = \frac{Vsig}{1 + Vsig\frac{k\mu}{C}t}$$

The expression (4) is substituted into the expression (5) and the opposite sides are integrated. Here, it is assumed that the initial state of the source voltage V (Vs) is −Vth32 and the time width of the mobility correction period t6 to t7 is represented by t (hereinafter referred to as "mobility correction time t"). By solving the differential equation, the drain-source current Ids with respect to the mobility correction period t is given by the following expression (6). Also in the expression (6), Vth32 is represented as Vth.

$$Ids = k\mu\left(\frac{Vsig}{1 + Vsig\frac{k\mu}{C}t}\right)^2 \quad (6)$$

Figure 6:
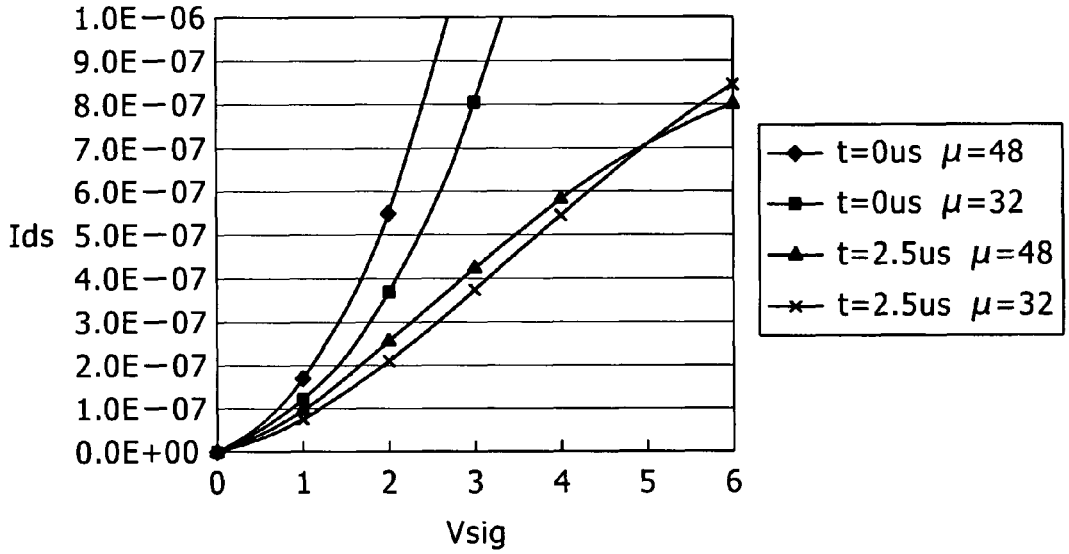
FIG. 6 is a diagram illustrating an input signal voltage and drain-source current when the time width is 0 μs and 2.5 μs.

A relationship between the input signal voltage Vsig and the drain-source current Ids of pixels which are different in mobility μ from each other when t=0 μs and t=2.5 μs in the expression (5) given hereinabove is illustrated in FIG. 6. As can be seen apparently from FIG. 6, the mobility μ at t=2.5 μs is corrected sufficiently against dispersion when compared with the mobility μ when no correction is applied to the mobility at t=0 μs. While dispersion of the mobility μ by 40% is involved where no correction is applied to the mobility, the dispersion of the mobility μ is suppressed to 10% or less by applying correction of the mobility.

In the mobility correction operation, it is necessary to normally satisfy the relationship of V (Vs)<Vthel. In the pixel circuit 11 according to the present embodiment, the capacitance value Cs (capacitor 37) and the capacitance value Coled of the organic EL element 31 act for correction of the mobility. Since the capacitance value Coled of the organic EL element 31 is higher than the capacitance value Cs, also the composite capacitance C has a high value, and consequently, a margin to the mobility correction time t can be provided.

Here, an optimum mobility correction time t is studied. First, by deforming the expression (6), which uses the coefficient k (=(½)·(W/L)·Cox), using a coefficient β(=μ·(W/L)·Cox) which includes the mobility μ in place of the coefficient k, the following expression (7) is obtained:

$$Ids=(\beta/2)\cdot\{(1/Vsig)\cdot(\beta/2)\cdot(t/C)\}^{-2} \quad (7)$$

where C is the capacitance of the node which is discharged when the mobility correction is performed. In the present circuit, the composite capacitance C is C=Cs+Coled. However, the composite capacitance C is not limited to C=Cs+Coled depending upon the circuit configuration.

The optimum condition is the point at which the variation of the drain-source current Ids is smallest with respect to the dispersion of the mobility μ, that is, at the point of dIds/dμ=0. If the expression (7) is solved in accordance with this condition, then where the average of β is represented by β0, the optimum correction time t0 is given by $$t0(\beta=0)=C/(\beta\cdot Vsig) \quad (8)$$

From the expression (8), it can be recognized that, as the input signal voltage Vsig (=Vdata) increases, the optimum mobility correction time t decreases. In particular, it can be recognized that the optimum mobility correction time t and the input signal voltage Vsig have an inverse proportional relationship to each other. In other words, if the mobility correction time t is set so as to increase in inverse proportion to the input signal voltage Vsig, then the dependence of the drain-source current Ids of the driving transistor 32 upon the mobility μ can be canceled.

By returning the expression (8) into the expression (7), $$Ids(t=t0,\beta=\beta0)=\beta0\cdot/(Vsig/2)^2 \quad (9)$$

is obtained. In other words, it can be recognized that it is optimum to let the voltage between the gate and the source of the driving transistor 32, that is, the voltage Vgs−Vth32 across the capacitor 37, discharge from the input signal voltage Vsig down to Vsig/2.

Further, if the error amount r (=(β−β0)/β0) of an arbitrary coefficient β (coefficient β at an arbitrary mobility μ) from an average β0) is used to define the coefficient β as $$\beta=\beta0\cdot(1+r) \quad (10)$$

then the drain-source current Ids at the arbitrary coefficient β within the mobility correction time t is given by $$Ids(t=t0,\beta=\beta0)=\beta0\cdot\{(1+r)/2\}\cdot\{Vsig/(2+r)\} \quad (11)$$

Now, the dispersion at β and β0 is evaluated. In particular, $$\frac{Ids(t=t,\ \beta=\beta0)}{Ids(t=t0,\ \beta=\beta0)}=(1+r)/\{1+(r/2)\}^2 \quad (12)$$
$$=(1+r)/\{1+r+(r^2/4)\}$$

Thus, if $r^2$ is sufficiently small, then the mobility μ (∝β) is corrected fully.

As can be recognized apparently from the numerical value analysis of the mobility correction described above, by setting the mobility correction time t so as to increase in inverse proportion to the input signal voltage Vsig, the dependence of the drain-source current Ids of the driving transistor 32 upon the mobility μ can be canceled. In other words, the dispersion of the mobility μ among different pixels can be corrected.

It is to be noted that, where the optimum mobility correction time t represented by the expression (8) is t0, the influence when the mobility correction time t disperses is represented, when β=β0, by the following expression:

$$Ids(t,\beta=\beta0)/Ids(t0,\beta=\beta0)=(2/(1+t/t0))^2 \quad (13)$$

Here, if it is assumed that, if dispersion of approximately 10% is permitted as dispersion which does not provide an unfamiliar feeling in visual observation, for example, as dispersion of the drain-source current Ids, then by approximately solving the expression (13) above, $$Ids\propto t/t0 \quad (14)$$

is obtained. In other words, in order for the dispersion of the drain-source current Ids and the mobility correction time t to have a proportional relationship to each other, the dispersion of the mobility correction time t is permitted up to approximately 10%.

As can be seen apparently from the timing chart of FIG. 2, since both of the sampling transistor 33 and the switching transistor 34 are in a conducting state within the mobility correction time t (t6 to t7), the mobility correction time t depends upon the timing at which the state of the sampling transistor 33 changes from a conducting state to a non-conducting state. Then, the sampling transistor 33 cuts off, that is, enters a non-conducting state from a conducting state when the potential difference between the gate thereof and the data line 17, that is, the gate-source voltage thereof, becomes equal to the threshold voltage Vth33 thereof.

Figure 7:
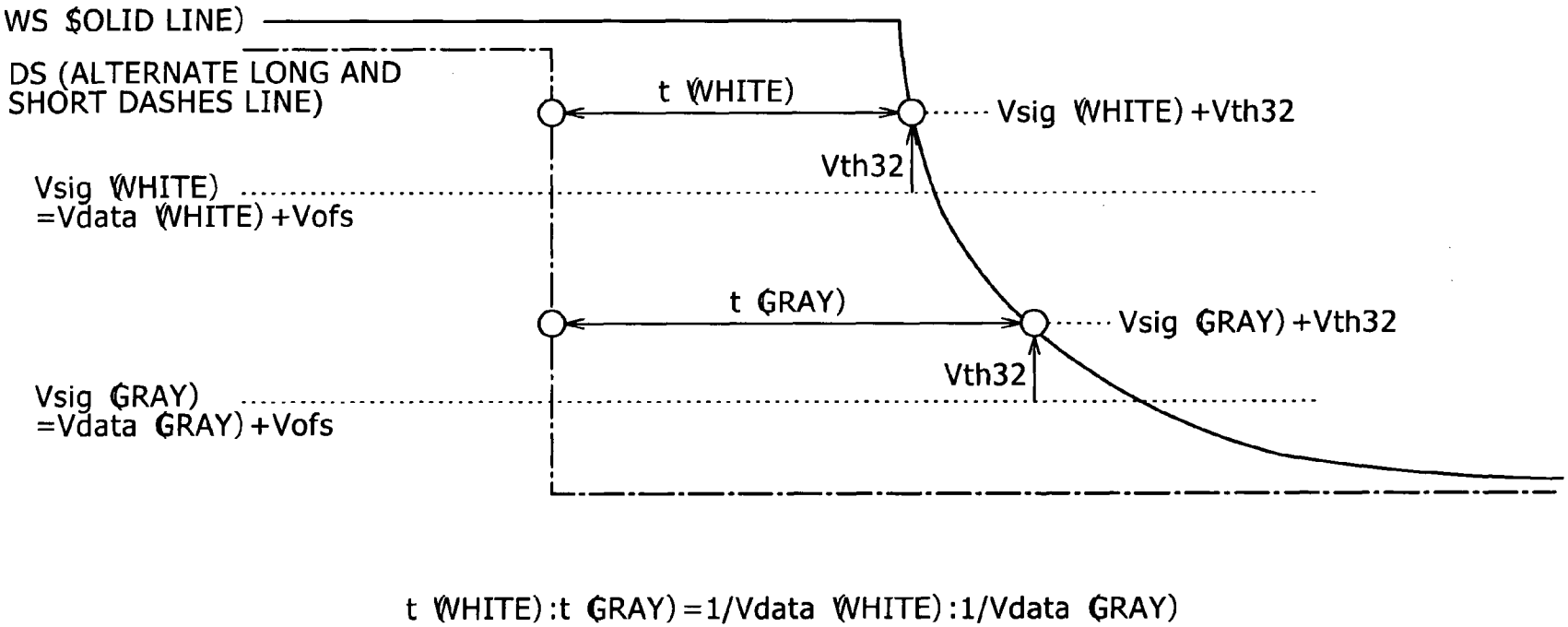
FIG. 7 is a waveform diagram showing a falling edge waveform of the writing signal.

Therefore, in the present embodiment, the writing signal WS to be applied from the writing scanning circuit 18 to the gate of the sampling transistor 33 through the scanning line 13 is produced such that the falling edge waveform thereof (rising edge waveform where the sampling transistor 33 is otherwise of the P-channel type) when the level thereof changes from the "H" level to the "L" level may exhibit an inverse proportional relationship to the effective input signal voltage Vdata (=Vsig−Vofs) as seen in FIG. 7.

By setting the falling edge waveform of the writing signal WS such that it increases in inverse proportion to the input signal voltage Vsig, when the gate-source voltage of the sampling transistor 33 becomes equal to the threshold voltage Vth33, the sampling transistor 33 cuts off. Consequently, the mobility correction time t can be set so as to increase in inverse proportion to the input signal voltage Vsig.

More particularly, as apparent from the waveform diagram of FIG. 7, when the input signal voltage Vsig (white) corresponding to the white level is inputted to the sampling transistor 33, the mobility correction time t (white) is set shortest so that the sampling transistor 33 may cut off when the gate-source voltage of the sampling transistor 33 becomes equal to Vsig (white)+Vth33. However, when the input signal voltage Vsig (gray) corresponding to a gray level is inputted to the sampling transistor 33, the mobility correction time t (gray) is set longer than the mobility correction time t (white) so that the sampling transistor 33 may cut off when the gate-source voltage becomes equal to the Vsig (gray)+Vth33.

By setting the mobility correction time t so as to increase in inverse proportion to the input signal voltage Vsig in this manner, optimum mobility correction time t to the input signal voltage Vsig can be set. Therefore, the dependence of the drain-source current Ids of the driving transistor 32 upon the mobility μ can be canceled with a higher degree of certainty over an overall level range (all gradations) of the input signal voltage Vsig from the black level to the white level. In other words, the mobility μ can be corrected with a higher degree of certainty against the dispersion among different pixels.

[Writing Scanning Circuit]

Now, a particular example of the writing scanning circuit 18 for producing the writing signal WS having a waveform which increases, at a falling edge thereof, in inverse proportion to the input signal voltage Vsig is described.

Figure 8:
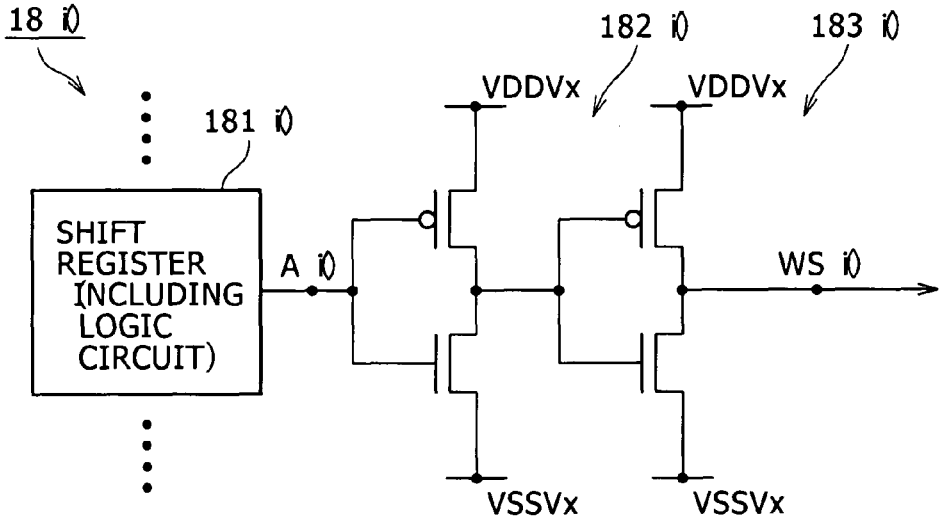
FIG. 8 is a circuit diagram showing an example of a circuit configuration of a writing scanning circuit.

FIG. 8 shows an example of a circuit configuration of the writing scanning circuit 18. In particular, FIG. 8 shows a circuit configuration of a shift stage (i) which corresponds to the ith row of the pixel array section 12. However, also the other shift stages have a same circuit configuration.

Referring to FIG. 8, the shift stage (i) of the writing scanning circuit 18 includes a shift register 181(*i*) including a logic circuit, and, for example, two stages of buffers 182(*i*) and 183(*i*). Each of the buffers 182(*i*) and 183(*i*) includes a CMOS inverter connected between a positive side power supply potential VDDVx and a negative side power supply potential VSSVx.

Figure 9:
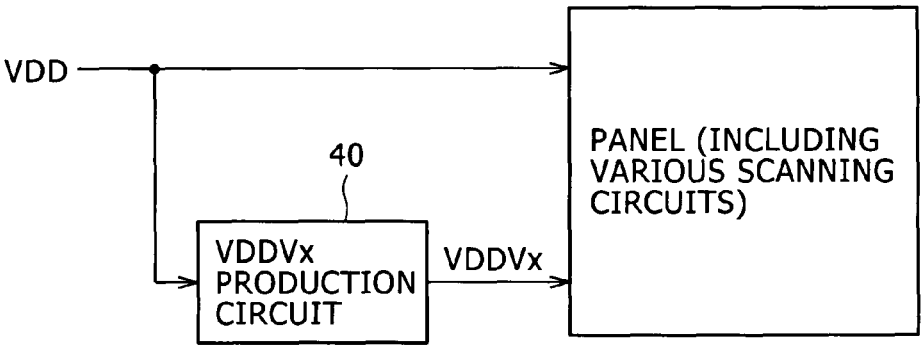
FIG. 9 is a block diagram showing a circuit system for producing a power supply potential.
Figure 10:
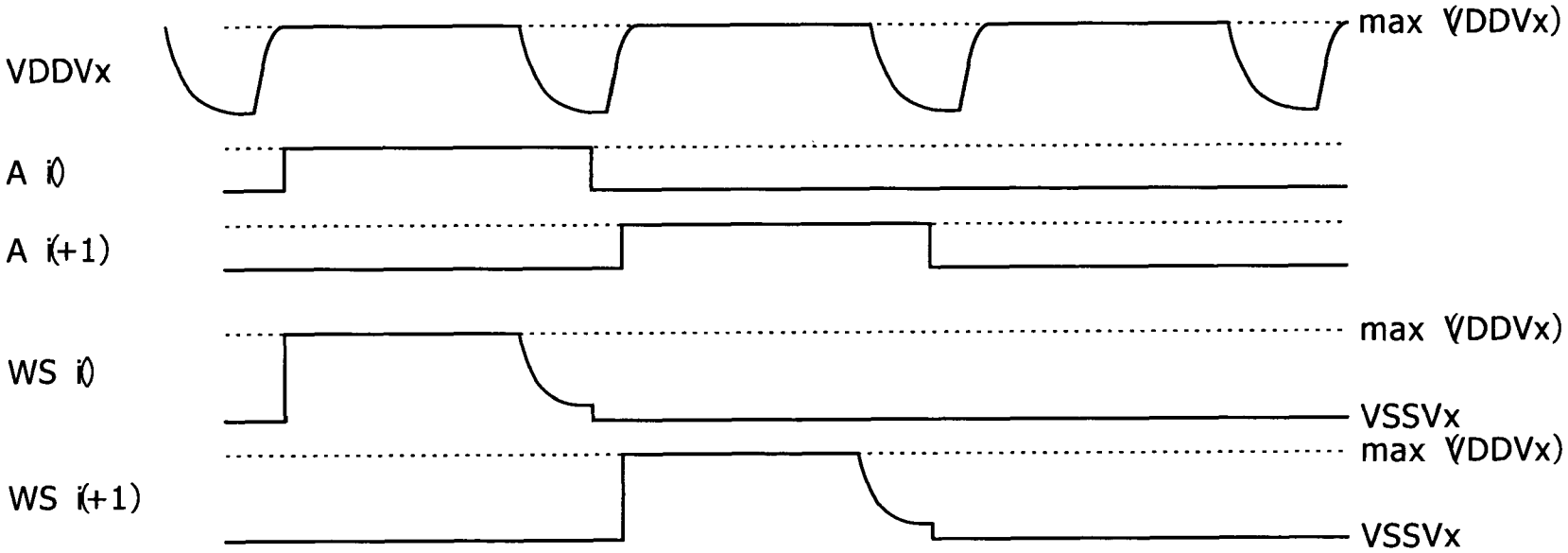
FIG. 10 is a timing chart illustrating a timing relationship among the power supply potential, scanning pulse and writing pulse.

The negative side power supply potential VSSVx is the first power supply potential VSS. The positive side positive side power supply potential VDDVx is produced based on the second power supply potential VDD by a VDDVx production circuit 40 as seen in FIG. 9. Referring to FIG. 10, the VDDVx production circuit 40 produces, at an end portion of a scanning pulse A(i) of a pulse waveform outputted from the ith shift register 181(*i*), based on the second power supply potential VDD, a power supply potential VDDVx of an analog waveform (refer to FIG. 7) which falls in an inverse proportion to the input signal voltage Vsig.

Since the power supply potential VDDVx of such an analog waveform that it falls in inverse proportion to the input signal voltage Vsig at an end portion of the scanning pulse A(i) is supplied as the positive side power supply potential to the buffers 182(*i*) and 183(*i*) and the scanning pulse A(i) outputted from the shift register 181(*i*) is outputted as a writing signal WS(i) through the buffers 182(*i*) and 183(*i*) in this manner. Which enable to produce a writing signal WS(i) of a waveform which falls in inverse proportion to the input signal voltage Vsig as seen in FIG. 10.

(VDDVx Production Circuit)

Figure 11:
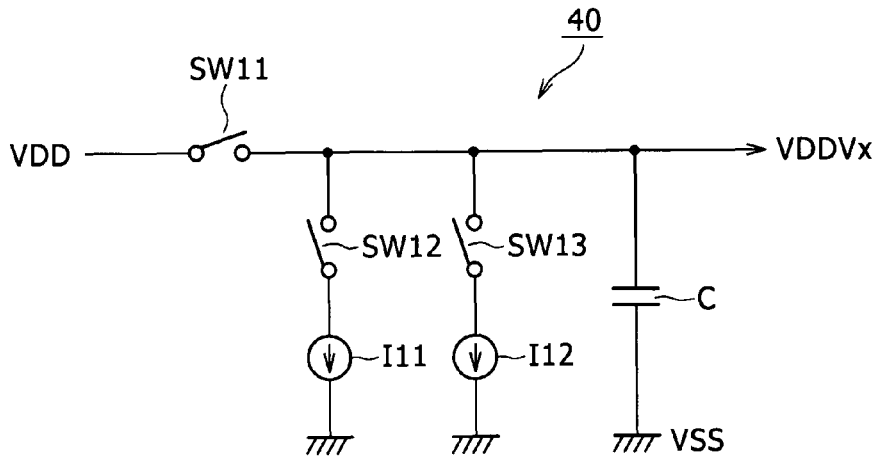
FIG. 11 is a circuit diagram showing an example of a circuit configuration of a power supply potential generation circuit.

FIG. 11 shows an example of a circuit configuration of the VDDVx production circuit 40. Referring to FIG. 11, the VDDVx production circuit 40 includes, for example, three switches SW11, SW12 and SW13, two current sources I11 and I12 and a capacitor C. The switch SW11 selectively fetches the second power supply potential VDD. The capacitor C is connected between the output terminal of the switch SW11 and the power supply potential VSS, which is, in the arrangement shown in FIG. 11, the ground potential GND, and is charged by the power supply potential VDD inputted through the switch SW11.

The switch SW12 and the current source I11 are connected in series and the switch SW13 and the current source I12 are connected in series, both between the output terminal of the switch SW11 and the first power supply potential VSS. The current source I11 is formed, for example, from a resistance element of a low resistance value and supplies current of a high current value. The current source I12 is formed from a resistance element having a higher resistance value than that of the current source I11 and supplies current of a lower current value than that of the current source I11.

Figure 12:
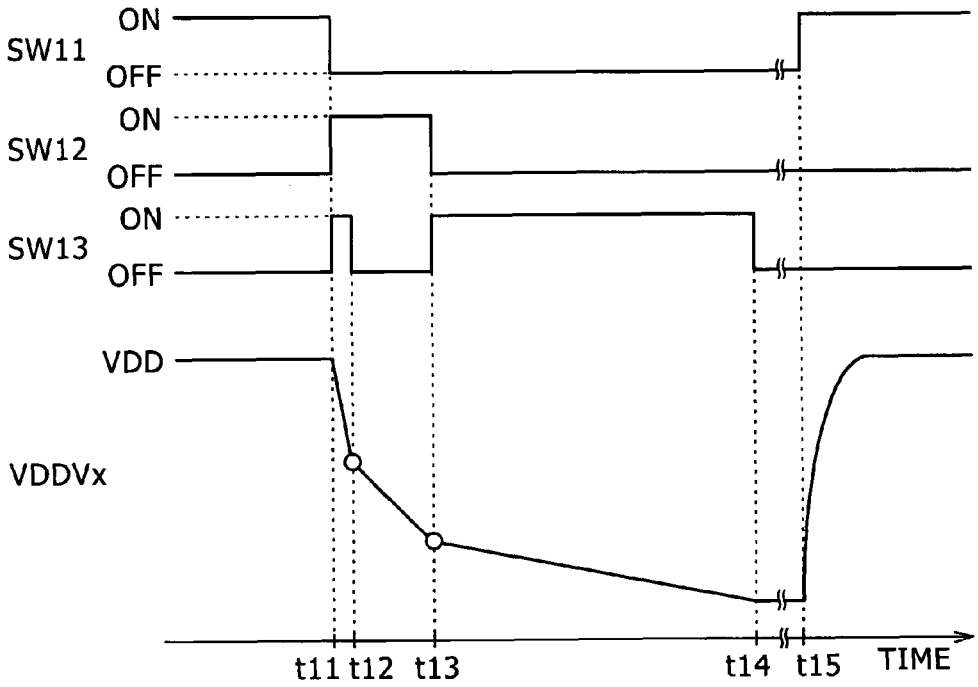
FIG. 12 is a timing chart illustrating a timing relationship of on/off driving of switches shown in FIG. 11.

FIG. 12 illustrates a timing relationship in on (closed)/off (open) driving of the switches SW11, SW12 and SW13. The switch SW11 remains in an on state before an adjustment period for the mobility correction time t within which the mobility correction time t is to be adjusted in response to the input signal voltage Vsig is entered. Consequently, the capacitor C is in a state charged up by the second power supply potential VDD, and therefore, the power supply potential VDDVx which is a terminal potential (output potential) of the capacitor C is equal to the power supply potential VDD.

When an adjustment period for the mobility correction time t is entered at time t11, the switch SW11 is switched off and both of the switches SW12 and SW13 are switched on. Consequently, the charge of the capacitor C is discharged along a path of the switch SW12 and the current source I11 and another path of the switch SW13 and the current source I12. At this time, since the charge of the capacitor C is discharged quickly with a current value composed of current values of the current sources I11 and I12, the power supply potential VDDVx drops suddenly from the second power supply potential VDD.

Then at time t12, the switch SW13 is switched off while the switch SW12 remains in an on state. Consequently, the charge of the capacitor C is discharged through the path of the switch SW12 and the current source I11 with a current value of the current source I11 lower than the current value in the case wherein both of the switches SW12 and SW13 are on. At this time, the positive side power supply potential VDDVx drops in a slope more moderate than a decreasing slope in the case wherein the both of the switches SW12 and SW13 are on.

Then at time t13, the switch SW12 is switched off and the switch SW13 is switched on. Consequently, the charge of the capacitor C flows along the path of the switch SW13 and the current source I12 and is discharged with a current value of the current source I12 lower than the current value in the case wherein the switch SW12 is on. At this time, the power supply potential VDDVx decreases along a slope further more moderate than the decreasing slope when the switch SW12 is on.

The switch SW13 is switched off at time t14, and then the switch SW11 is switched on at time t15. Consequently, charging of the capacitor C by the second power supply potential VDD is started. Finally, the power supply potential VDDVx converges to the second power supply potential VDD.

In this manner, a plurality of current sources, in the example described hereinabove with reference to FIG. 11, two current sources I11 and I12, having different current values from each other are connected in a suitable combination in parallel to each other to the capacitor C which is in a state charged up by the second power supply potential VDD. Which enable to produce a power supply potential VDDVx having a falling edge waveform of a polygonal line which is bent, in the example described hereinabove with reference to FIG. 12, at the points 1 and 2 as seen in FIG. 12.

Figure 13:
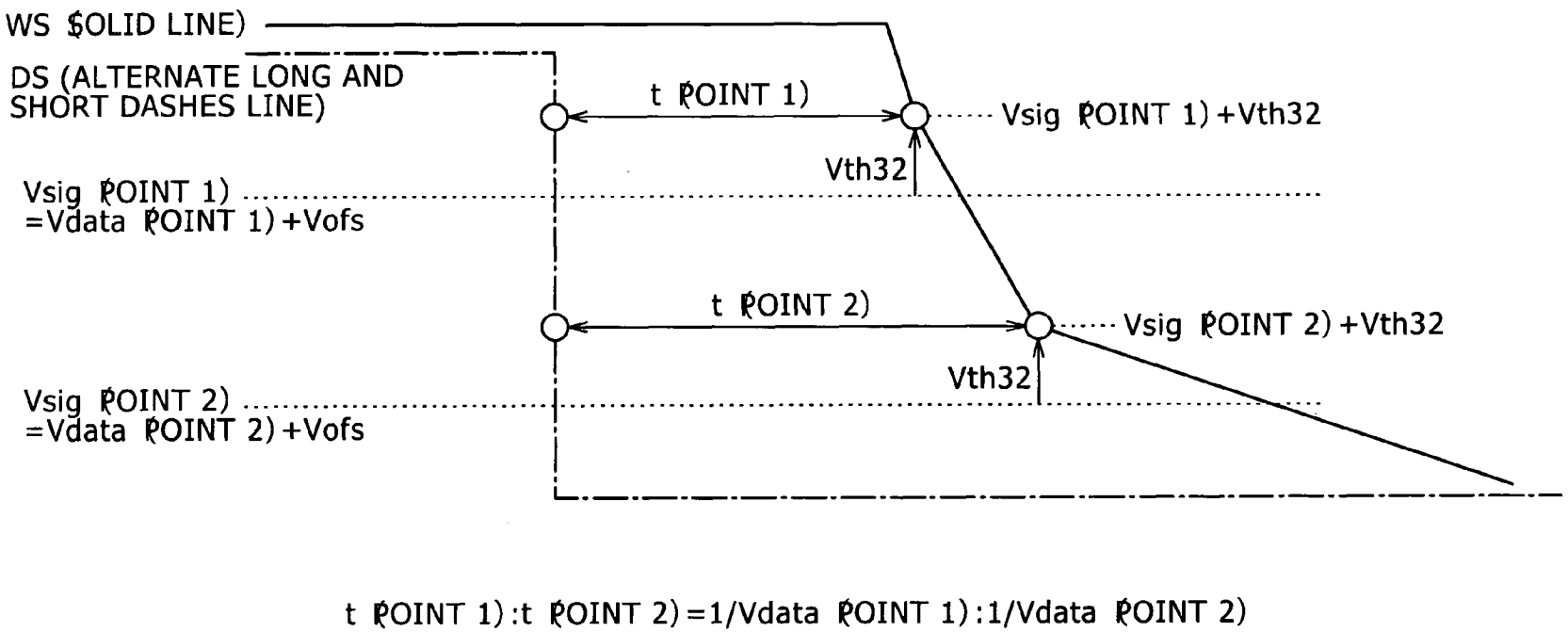
FIG. 13 is a waveform diagram showing a falling edge waveform of the writing signal where a power supply potential having a falling edge waveform of a polygonal line is used.

FIG. 13 illustrates a falling edge waveform of the writing signal WS where the power supply potential VDDVx having a falling edge waveform of a polygonal line is used as a power supply voltage on the positive side for the buffers 182(*i*) and 183(*i*) of the writing scanning circuit 18. In this instance, also the falling edge waveform of the writing signal WS becomes a falling edge waveform of a polygonal line which is bent at the points 1 and 2.

Here, since a writing signal WS having a falling edge waveform of a polygonal line which increases substantially in inverse proportion to the input signal voltage Vsig can be produced by selecting the current values of the current sources I11 and I12 to desired values, the mobility correction time t can be set so as to increase substantially in inverse proportion to the input signal voltage Vsig. Consequently, since the mobility correction time t corresponding to the input signal voltage Vsig can be set, the dispersion of the mobility μ among the pixels can be corrected with a higher degree of certainty over the overall level range of the input signal voltage Vsig from the black level to the white level.

In the circuit configuration of FIG. 11, the number of bent points can be increased by increasing the number of current sources, and a writing signal WS having a falling edge waveform of a polygonal line proximate to the falling characteristic of FIG. 7 can be produced.

It is to be noted that, in the embodiment described above, the present embodiment is applied to a display apparatus which uses the pixel circuit 11 which includes the driving transistor 32, sampling transistor 33, switching transistors 34 to 36 and capacitor 37 in addition, for example, to the organic EL element 31 which is an electro-optical element. However, the present invention is not limited to this application. In the following, the present invention is described in connection with several different examples of a pixel circuit.

[Different Pixel Circuit 1]

Figure 14:
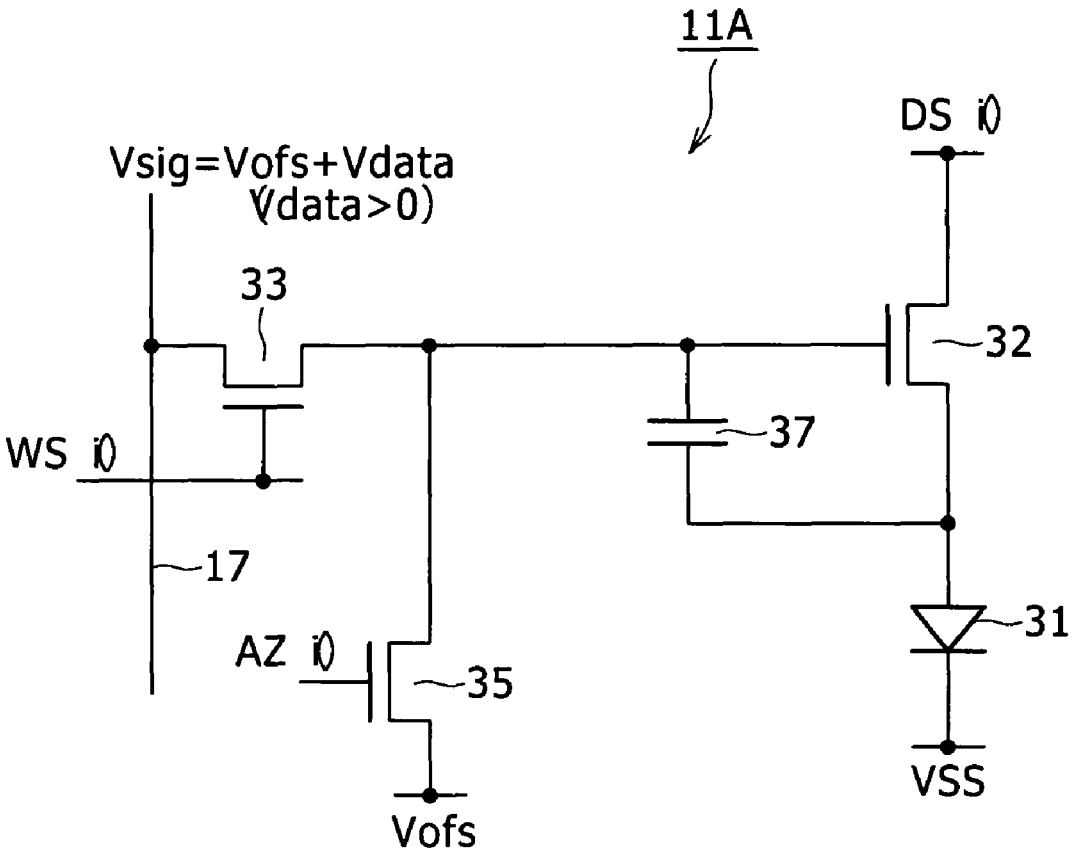
FIG. 14 is a circuit diagram showing another circuit configuration of the pixel circuit.

FIG. 14 shows a circuit configuration of a different pixel circuit 1 (11A). Referring to FIG. 14, the different pixel circuit 11A shown has a configuration which includes, as components thereof, a driving transistor 32, a sampling transistor 33, a switching transistor 35 and a capacitor 37 in addition to an organic EL element 31.

An N-channel TFT is used for the driving transistor 32, sampling transistor 33 and switching transistor 35. However, the combination of the conduction types of the driving transistor 32, sampling transistor 33 and switching transistor 35 is a mere example and is not used restrictively.

The organic EL element 31 is connected at the cathode electrode thereof to a first power supply potential VSS which is, in the arrangement of FIG. 14, the ground potential GND. The driving transistor 32 drives the organic EL element 31 with current, and is connected at the source thereof to the anode electrode of the organic EL element 31 such that a source follower circuit is formed. Further, the driving transistor 32 receives a driving signal DS at the drain thereof. The sampling transistor 33 is connected at the source thereof to the data line 17 and at the drain thereof to the gate of the driving transistor 32, and receives a writing signal WS at the gate thereof.

The switching transistor 35 is connected at the drain thereof to a third power supply potential Vofs and at the source thereof to the drain of the sampling transistor 33 and gate of the driving transistor 32, and receives a correcting scanning signal AZ at the gate thereof. The capacitor 37 is connected at one terminal thereof to the gate of the driving transistor 32 and drain of the sampling transistor 33 and at the other terminal thereof to the source of the driving transistor 32 and anode electrode of the organic EL element 31.

In the different pixel circuit 11A wherein the components are connected in such a connection scheme as described above, the components operate in the following manner. In particular, when the sampling transistor 33 is in a conducting state, it samples an input signal voltage Vsig (=Vofs+Vdata; Vdata>0) supplied thereto from a data line 17. The input signal voltage Vsig is held by the capacitor 37.

When the power supply potential VDD is applied to the drain of the driving transistor 32, the driving transistor 32 supplies current of a current value based on the input signal voltage Vsig held in the capacitor 37 to the organic EL element 31 to drive the organic EL element 31 (current driving). The switching transistor 35 suitably enters a conducting state, in which it detects the threshold voltage Vth32 of the driving transistor 32 prior to the current driving of the organic EL element 31 and holds the detected threshold voltage Vth32 into the capacitor 37 in order to cancel the influence of the threshold voltage Vth32 in advance.

In the different pixel circuit 11A, the second power supply potential VDD is not fixed but is varied to the "L" level, which is, in the present example, the first power supply potential VSS, at a suitable timing to implement the function of the switching transistors 34 to 36 shown in FIG. 1. In particular, the power supply potential VDD corresponds to the driving signal DS for driving the switching transistor 34 in the pixel circuit 11 of FIG. 1. According to the circuit configuration of the different pixel circuit 11A, two transistors can be reduced from the pixel circuit 1 and wiring lines for the driving line 14 and the second correcting scanning line 16 in FIG. 1 can be reduced when compared with those in the pixel circuit 11 of FIG. 1.

It is to be noted that, since the different pixel circuit 11A described above does not have a period within which both of the writing signal WS and the correcting scanning signal AZ simultaneously exhibit the "H" level, it is possible to form the switching transistor 35 commonly with the sampling transistor 33 and form the power supply line of the third power supply potential Vofs commonly with the data line (signal line) 17. In this instance, the power supply potential Vofs should be supplied within a period within which the correcting scanning signal AZ has the "H" level and the input signal voltage Vsig should be supplied within another period within which the writing signal WS has the "H" level, both from the data line 17.

Figure 15:
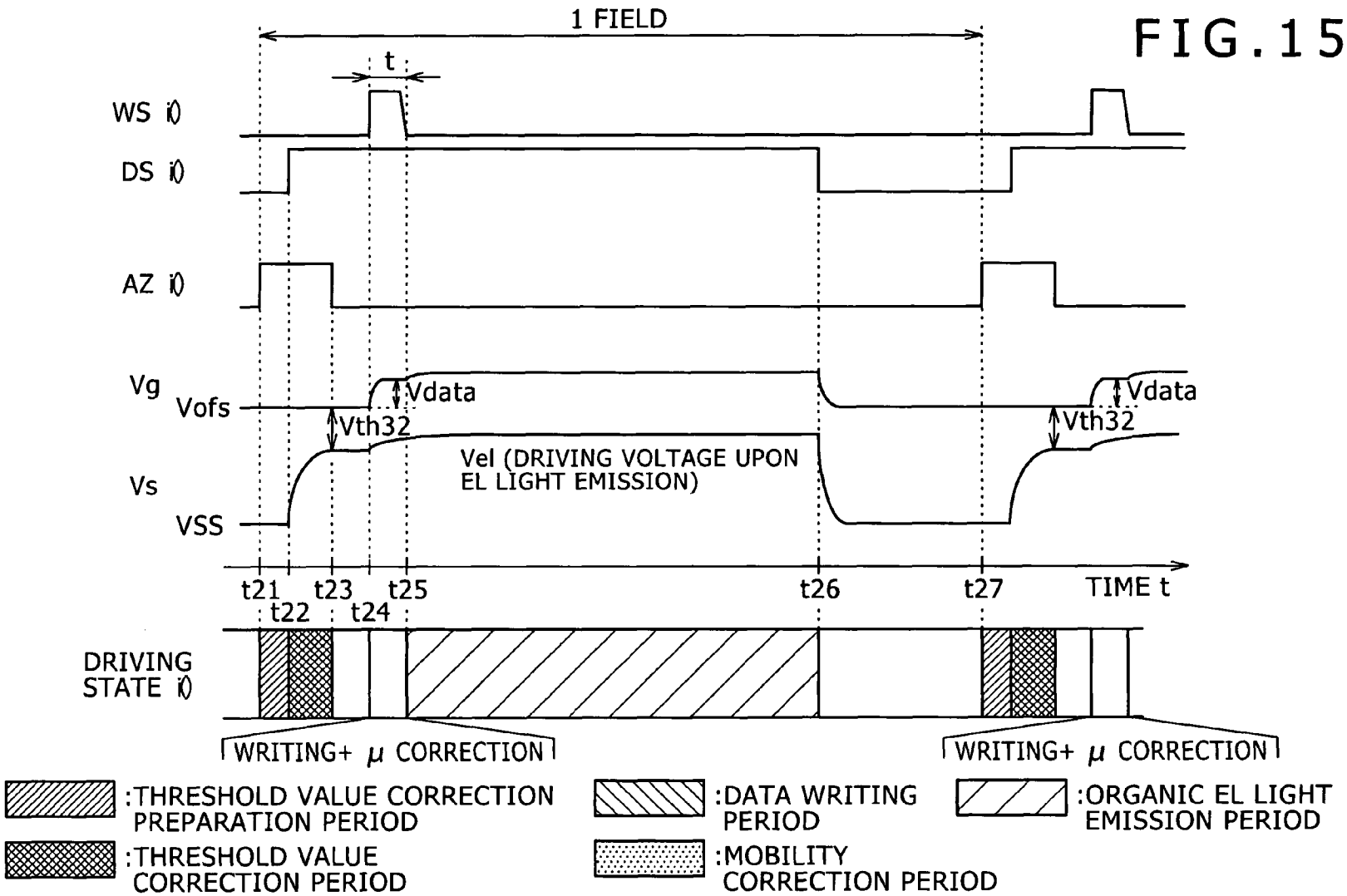
FIG. 15 is a timing waveform diagram illustrating a timing relationship among the writing signal, driving signal and first correcting scanning signal used in the pixel circuit of FIG. 14 and a variation of the gate potential and the source potential of the driving transistor.

FIG. 15 illustrates a timing relationship of the writing signal WS, driving signal DS and first correcting scanning signal AZ1 for driving the different pixel circuit 11A and a variation of the gate potential Vg and the source potential Vs of the driving transistor 32.

In the timing waveform diagram of FIG. 15, a period from time t21 to time t27 forms one field period. Within the one field period, the period t21 to t22 is a threshold value correction preparation period, the period t22 to t23 is a threshold value correction period, the period t24 to t25 is a data writing+mobility correction period, and the period t25 to t26 is a light emission period of the organic EL element 31.

In particular, in the different pixel circuit 11A, when the correcting scanning signal AZ exhibits the "H" level while the second power supply potential VDD has the VSS level (t21 to t22), threshold value correction preparation for preparing for correction of the dispersion of the threshold voltage Vth32 of the driving transistor 32 is performed. Then, when the writing signal WS exhibits the "H" level while the second power supply potential VDD has the VDD level (t24 to t25), writing of the data Vdata and dispersion correction of the mobility μ of the driving transistor 32 are performed concurrently.

In this manner, also in the different pixel circuit 11A having the configuration which includes, in addition to the organic EL element 31, the driving transistor 32, sampling transistor 33, switching transistor 35 and capacitor 37 as components thereof, threshold value correction of correcting the threshold voltage Vth32 of the driving transistor 32 against the dispersion among the pixels (cancellation of the dispersion) and mobility correction of correcting the mobility μ of the driving transistor 32 against the dispersion among the pixels can be executed. As a result of execution of the correction functions, the display apparatus can display an image of high picture quality free from luminance dispersion arising from characteristic dispersion of the driving transistors 32.

In the correction of the mobility μ, optimum mobility correction time t to the input signal voltage Vsig can be set by setting the pulse width of the writing signal WS, or more particularly, by setting the mobility correction time t which depends upon the falling edge waveform of the writing signal WS so as to increase in inverse proportion to the input signal voltage Vsig. Therefore, the dependence of the drain-source current Ids of the driving transistor 32 upon the mobility μ can be canceled with a higher degree of certainty over an overall level range of the input signal voltage Vsig from the black level to the white level. In other words, the mobility μ can be corrected with a higher degree of certainty against the dispersion among different pixels.

A writing signal WS which has a falling edge waveform which increases in inverse proportion to the effective input signal voltage Vdata applied to the gate of the driving transistor 32 can be produced. The writing signal WS is produced by supplying a positive side power supply potential VDDVx of an analog waveform which is produced by the VDDVx production circuit 40 shown in FIG. 9 and falls in inverse proportion to the input signal voltage Vsig as the positive side power supply potential to the buffers 182(*i*) and 183(*i*) of the writing scanning circuit 18 shown in FIG. 8.

It is to be noted that the pixel circuit 11 may be modified such that the input signal voltage Vsig and the power supply potential Vofs are supplied time-divisionally through the data line 17 so as to be written time-divisionally by the sampling transistor 33. Where the configuration just described is adopted, it is possible to provide the sampling transistor 33 with the function of the switching transistor 35. Consequently, the number of transistors can be further reduced and also the wiring line for the first correcting scanning line 15 in FIG. 1 can be reduced.

[Different Pixel Circuit 2]

Figure 16:
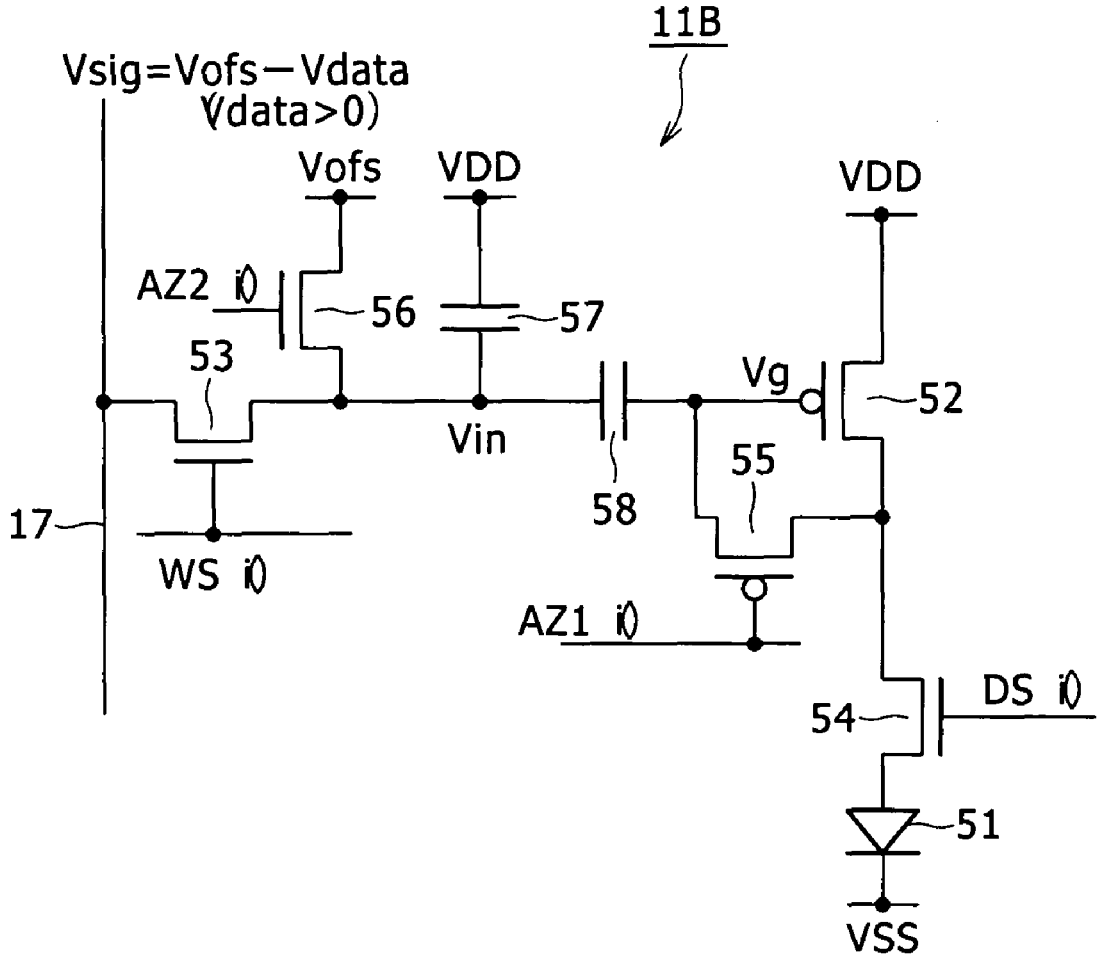
FIG. 16 is a circuit diagram showing a further circuit configuration of the pixel circuit.

FIG. 16 shows a circuit configuration of a different pixel circuit 2 (11B). Referring to FIG. 16, the pixel circuit 11B shown includes, in addition to an organic EL element 51, a driving transistor 52, a sampling transistor 53, switching transistors 54 to 56 and capacitors 57 and 58.

A P-channel TFT is used for the driving transistor 52 and switching transistor 55, and an N-channel transistor is used for the sampling transistor 53 and switching transistors 54 and 56. However, the combination of the conduction types of the driving transistor 52, sampling transistor 53 and switching transistors 54 to 56 is a mere example and is not used restrictively.

The organic EL element 51 is connected at the cathode electrode thereof to a power supply potential VSS which is, in the arrangement of FIG. 16, the ground potential GND. The driving transistor 52 drives the organic EL element 51 with current, and is connected at the source thereof to the second power supply potential VDD which is, in the arrangement of FIG. 16, a positive power supply potential. The sampling transistor 53 is connected at the source thereof to the data line 17 and at the drain thereof to a node N21, and receives a writing signal WS at the gate thereof.

The switching transistor 54 is connected at the drain thereof to the drain of the driving transistor 52 and at the source thereof to the anode electrode of the organic EL element 51, and receives a driving signal DS at the gate thereof. The switching transistor 55 is connected between the gate and the source of the driving transistor 52 and suitably receives a first correcting scanning signal AZ1 at the gate thereof.

The switching transistor 56 is connected at the drain thereof to the third power supply potential Vofs and at the source thereof to the node N21 and suitably receives a second correcting scanning signal AZ2 at the gate thereof. The capacitor 57 is connected between the second power supply potential VDD and the node N21. The capacitor 58 is connected between the node N21 and the gate of the driving transistor 52.

Figure 17:
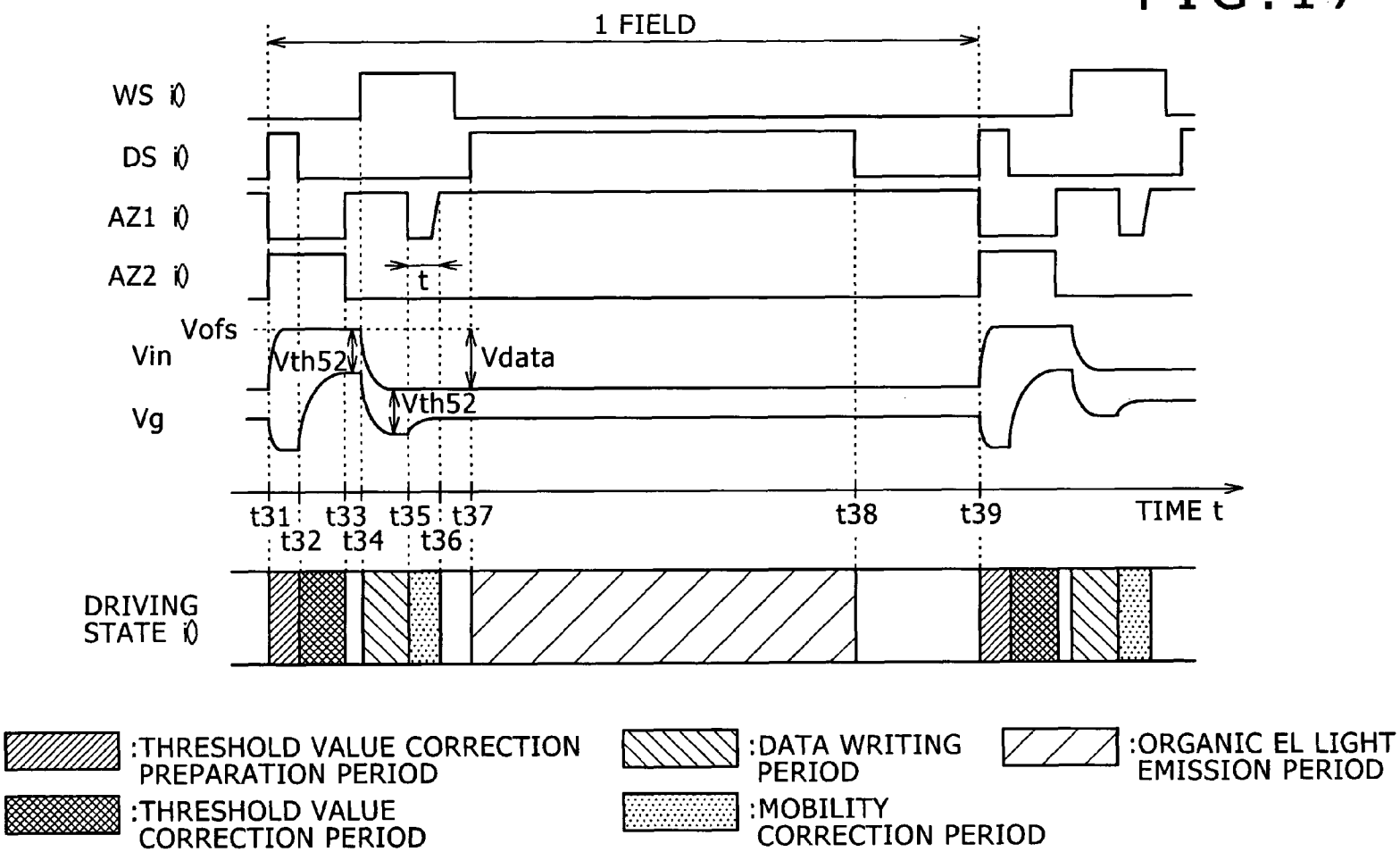
FIG. 17 is a timing waveform diagram illustrating a timing relationship among the writing signal, driving signal and first and second correcting scanning signals used in the pixel circuit of FIG. 16 and a variation of the gate potential and the source potential of the driving transistor.

FIG. 17 illustrates a timing relationship of the writing signal WS, driving signal DS and first and second correcting scanning signals AZ1 and AZ2 for driving the pixel circuit 11B and a variation of the potential Vin at the node N21 and the gate potential Vg of the driving transistor 52.

In the timing waveform diagram of FIG. 17, a period from time t31 to time t39 forms one field period. Within the one field period, the period t31 to t32 is a threshold value correction preparation period, the period t32 to t33 is a threshold value correction period, the period t34 to t35 is a data writing period, the period t35 to t36 is a mobility correction period, and the period t37 to t38 is a light emission period of the organic EL element 51.

In particular, in the pixel circuit 11B, when both the writing signal WS and the first correcting scanning signal AZ1 exhibit the "L" level while both of the driving signal DS and the second correcting scanning signal AZ2 have the "H" level (t31 to t32), threshold value correction preparation for preparing for correction of the dispersion of the threshold voltage Vth52 of the driving transistor 52 is performed. Then, when all of the writing signal WS, driving signal DS and first correcting scanning signal AZ1 exhibit the "L" level (t32 to t33), dispersion correction of the threshold voltage Vth52 of the driving transistor 52 is performed.

Further, when both of the writing signal WS and the first correcting scanning signal AZ1 exhibit the "H" level and both of the driving signal DS and the second correcting scanning signal AZ2 exhibit the "L" level (t34 to t36), writing of the data Vdata is performed. Then, when the level of the first correcting scanning signal AZ1 changes to the "L" level in a state wherein the writing signal WS has the "H" level, that is, writing of the input signal voltage Vdata is performed (t35 to t36), dispersion correction of the mobility μ of the driving transistor 52 is performed.

Within the normal light emission period (t37 to t38), both of the writing signal WS and the first correcting scanning signal AZ1 have the "L" level and both of the driving signal DS and the second correcting scanning signal AZ2 have the "H" level. Consequently, the sampling transistor 53 and the switching transistors 55 and 56 exhibit a non-conducting state, and the switching transistor 54 exhibits a conducting state. In this instance, the driving transistor 52 operates as a fixed current source because it is designed so as to operate in a saturation region.

As a result, fixed drain-source current Ids defined by the expression (1) given hereinabove is supplied from the driving transistor 52 to the organic EL element 51 through the switching transistor 54, and consequently, the organic EL element 51 emits light. Thereafter, when the level of the driving signal DS changes from the "L" level to the "H" level at time t38, the switching transistor 54 is rendered non-conducting and the current supply path to the driving transistor 52 is interrupted. Consequently, the emission of light of the organic EL element 51 stops, and a no-light emission period is entered.

In this manner, also in the pixel circuit 11B having the configuration which includes, in addition to the organic EL element 51, the driving transistor 52, sampling transistor 53, switching transistors 54 to 56 and capacitors 57 and 58 as components thereof, threshold value correction of correcting the threshold voltage Vth52 of the driving transistor 52 against the dispersion and mobility correction of correcting the mobility μ of the driving transistor 52 against the dispersion can be executed. As a result of execution of the correction functions, the display apparatus can display an image of high picture quality free from luminance dispersion arising from characteristic dispersion of the driving transistors 52.

In the correction of the mobility μ, optimum mobility correction time t to the input signal voltage Vsig can be set by setting the pulse width of the first correcting scanning signal AZ1, or more particularly, by setting the mobility correction time t which depends upon the rising edge waveform of the first correcting scanning signal AZ1 so as to increase in inverse proportion to the input signal voltage Vsig. Therefore, the dependence of the drain-source current Ids of the driving transistor 52 upon the mobility μ can be canceled with a higher degree of certainty over an overall level range of the input signal voltage Vsig from the black level to the white level. In other words, the mobility μ can be corrected with a higher degree of certainty against the dispersion among different pixels.

The first correcting scanning signal AZ1 which has a rising edge waveform which increases in inverse proportion to the input signal voltage Vsig can be produced using a principle similar to that of the VDDVx production circuit 40 shown in FIG. 9 (but opposite in polarity) by producing a power supply potential VSSVx of an analog waveform having a rising edge waveform which increases in inverse proportion to the input signal voltage Vsig. The first correcting scanning signal AZ1 can be produced by supplying the negative side power supply potential VSSVx as the power supply potential to the buffers 182(*i*) and 183(*i*) of the first correcting scanning circuit having a same configuration as that of the writing scanning circuit 18 shown in FIG. 8.

Figure 19:
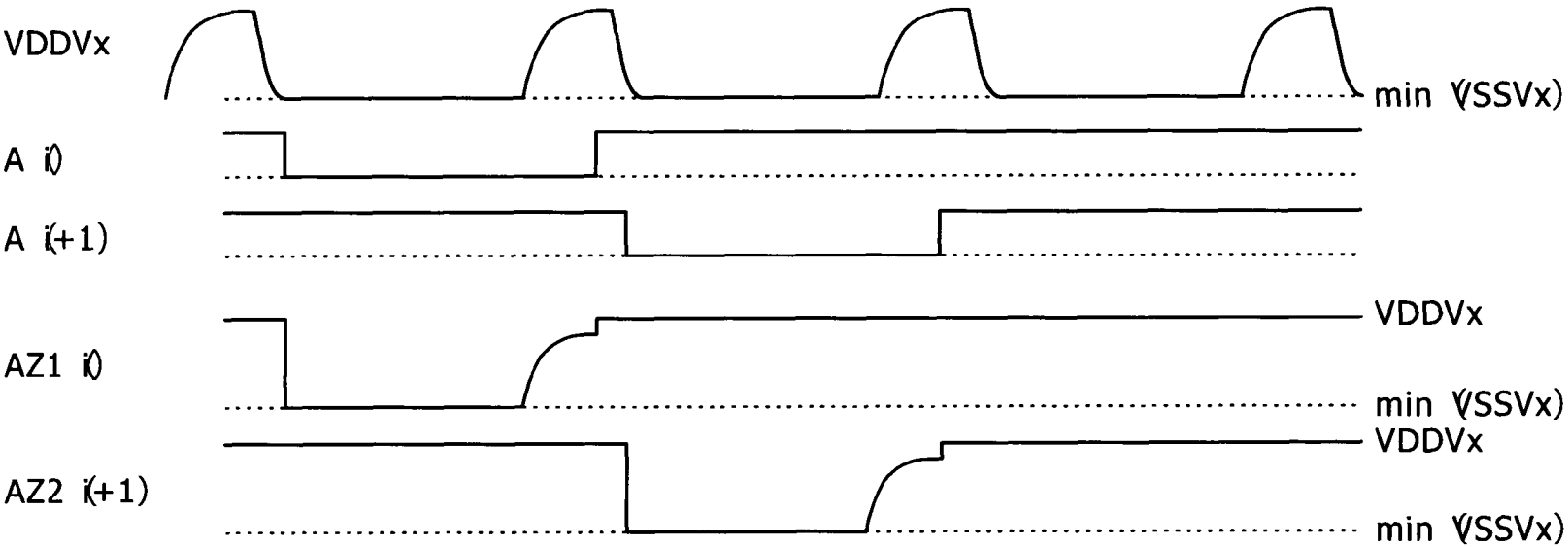
FIG. 19 is a timing chart illustrating a timing relationship among the power supply potential, scanning pulses and first correcting scanning signal in the pixel circuit of FIG. 16.

FIG. 19 illustrates a timing relationship of the negative side power supply potential VSSVx, scanning pulses A(i) and A(i+1) and first correcting scanning signals AZ1(*i*) and AZ1 (*i*+1).

Figure 18:
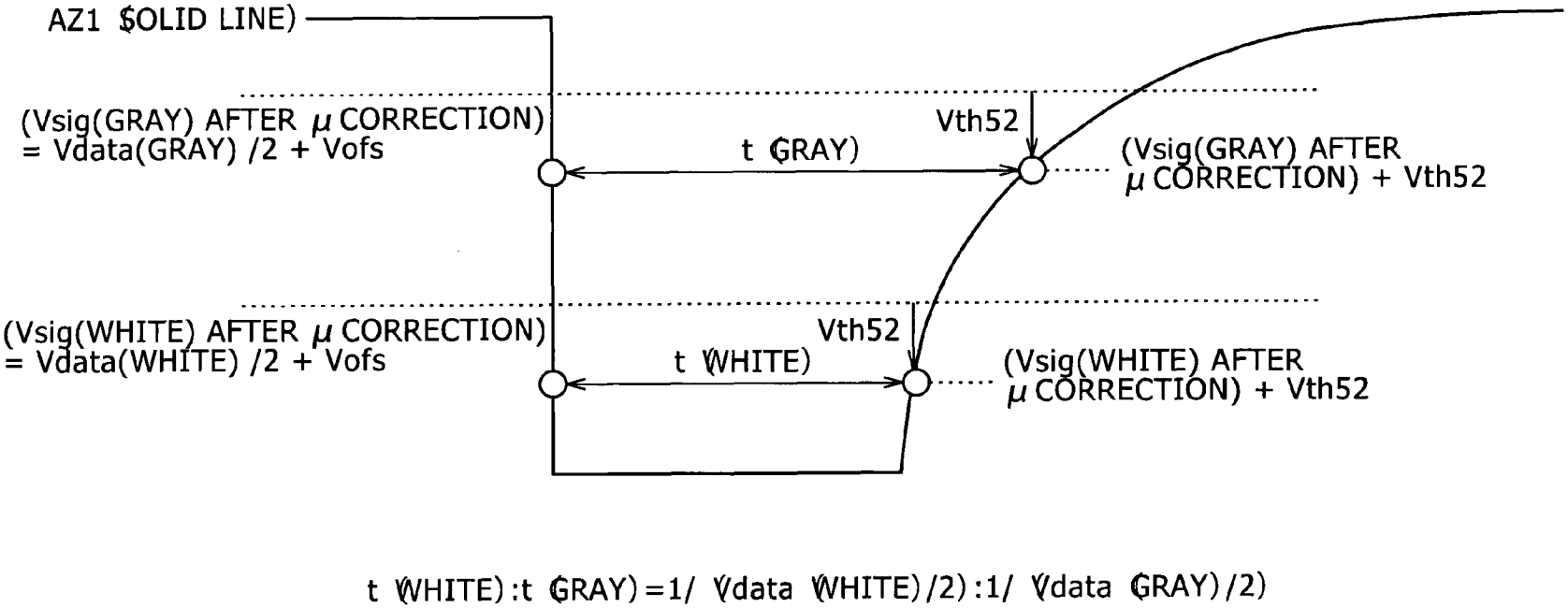
FIG. 18 is a waveform diagram showing a rising edge waveform of the first correcting scanning signal used in the pixel circuit of FIG. 16.

The first correcting scanning signal AZ1 to be applied to the gate of the P-channel switching transistor 55 connected between the gate and the source of the driving transistor 52 should be set such that it has such a rising edge waveform (where the switching transistor 55 is otherwise of the N-channel type, a falling edge waveform) as shown in FIG. 18 when the level of the first correcting scanning signal AZ1 changes from the "L" level to the "H" level. Here, if it is assumed that the gate-source voltage Vgs of the driving transistor 52 before the mobility correction satisfies Vgs−Vth=Vdata, then Vgs−Vth when corrected optimally is Vgs−Vth=Vdata/2 as given by the expression (9) given hereinabove. Accordingly, the rising edge waveform of the first correcting scanning signal AZ1 should be set such that the correction time may increase in inverse proportion to the effective input signal voltage Vdata to be applied to the gate of the driving transistor 52. That is, the rising edge waveform of the first correcting scanning signal AZ1 should be set such that the correction time may increase in inverse proportion to Vdata/2 which is one half the effective input signal voltage Vdata to be applied to the driving transistor 52 so that the switching transistor 55 may cut off when the gate-source voltage of the switching transistor 55 becomes equal to the threshold voltage Vth53.

More particularly, as can be seen apparently from the waveform diagram of FIG. 18, when the input signal voltage Vsig is an input signal voltage Vsig (white) which corresponds to the white level, the mobility correction time t (white) is set shortest so that the switching transistor 55 cuts off when the gate-source voltage of the switching transistor 55 becomes equal to (Vdata(white)/2)+Vofs+Vth53. On the other hand, when the input signal voltage Vsig is an input signal voltage Vsig (gray) which corresponds a gray level, the mobility correction time t (gray) is set longer than the mobility correction time t (white) so that the switching transistor 55 may cut off when the gate-source voltage of the switching transistor 55 becomes equal to (Vdata(gray)/2)+Vofs+Vth53.

Figure 20:
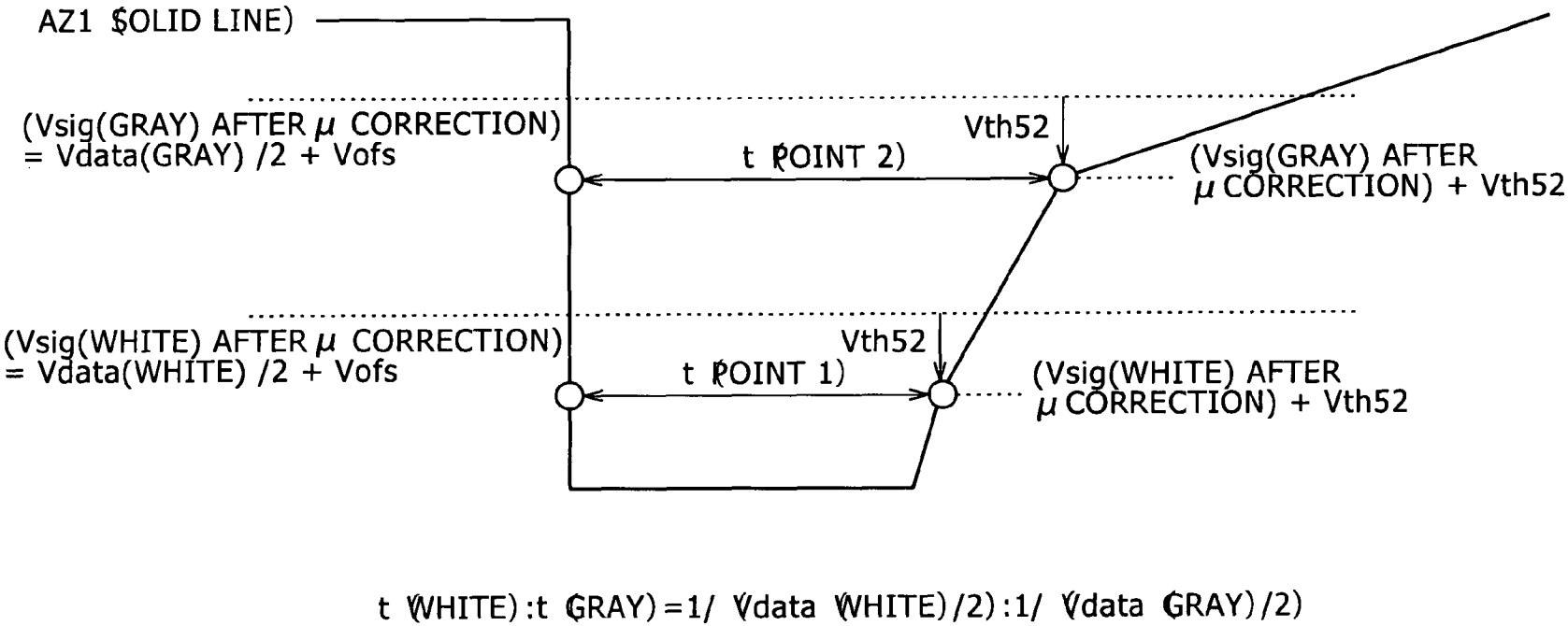
FIG. 20 is a waveform diagram showing a rising edge waveform of the first correcting scanning signal where a power supply potential having a rising edge waveform of a polygonal line is used in the pixel circuit of FIG. 16.

As a particular VSSVx production circuit for producing the power supply potential VSSVx of an analog waveform having a rising edge waveform which increases in inverse proportion to the effective input signal voltage Vdata to be applied to the gate of the driving transistor 32, a circuit configured in accordance with a basically same principle (opposite in polarity) as that of the VDDVx production circuit 40 shown in FIG. 11 can be used. Where the VSSVx production circuit just described is used, a power supply potential VSSVx having a rising edge waveform of a polygonal line can be produced. Then, where the first correcting scanning signal AZ1 is produced based on the power supply potential VSSVx, also the first correcting scanning signal AZ1 has a rising edge waveform of a polygonal line as seen in FIG. 20.

It is to be noted that the description above relates to a case wherein the voltage variation Vdata of the data line 17 upon data writing is applied fully to the gate-source voltage Vgs of the driving transistor 52. This is based on an assumption that the capacitor 58 has sufficiently high capacitance. If this (write gain: Gw)=(voltage variation of Vgs)/(voltage variation of signal line) is not 100%, then the input signal voltage Vdata should be rewritten into Gw·Vdata.

[Different Pixel Circuit 3]

Figure 21:
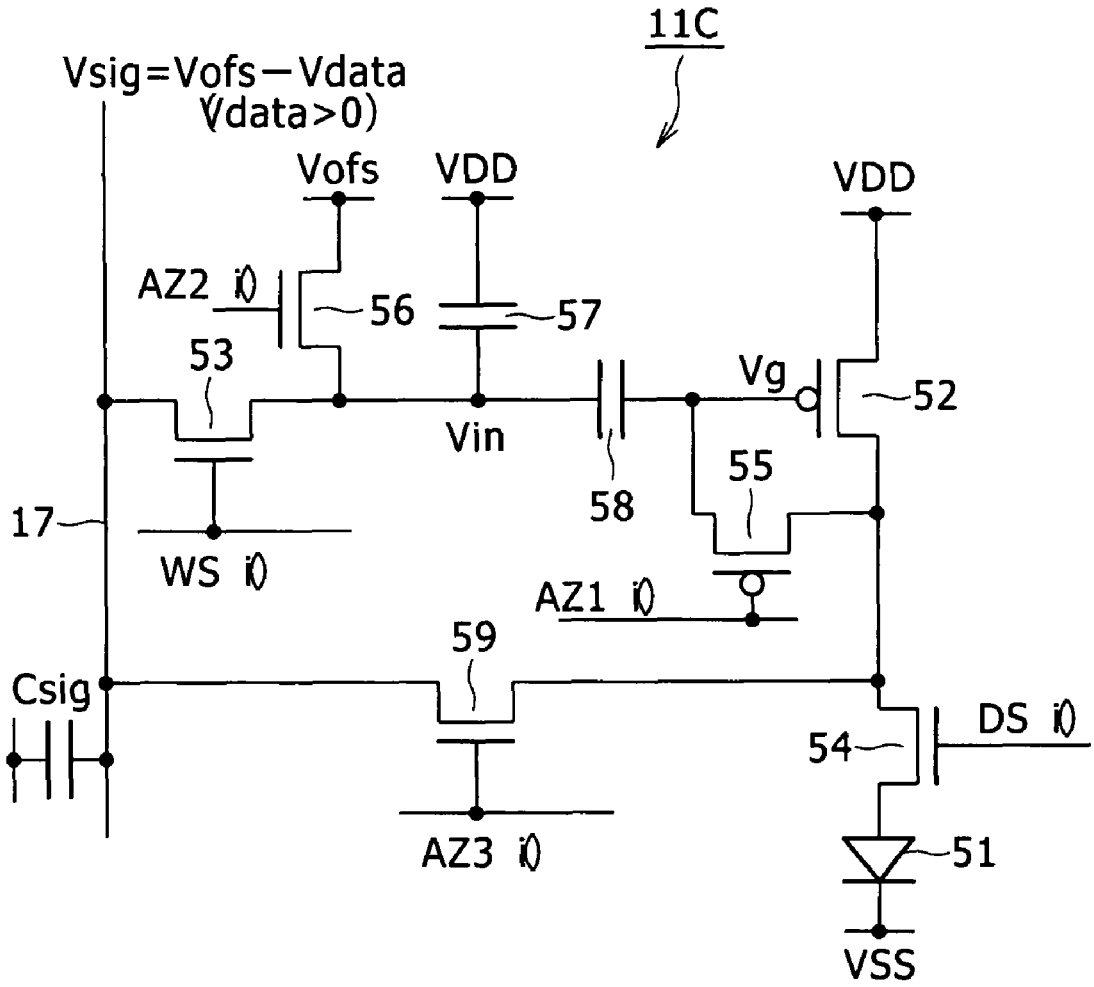
FIG. 21 is a circuit diagram showing a circuit configuration of a still further pixel circuit.

FIG. 21 shows a circuit configuration of a different pixel circuit 3 (11C). Referring to FIG. 21, the pixel circuit 11C has a circuit configuration which includes, in addition to an organic EL element 51, a driving transistor 52, a sampling transistor 53, switching transistors 54 to 56 and 59 and capacitors 57 and 58 as components thereof.

Thus, the pixel circuit 11C has the configuration which includes the switching transistor 59 in addition to the components of the pixel circuit 11B of FIG. 16. The switching transistor 59 is connected between the data line 17 and the drain of the driving transistor 52 and drain of the switching transistor 54 and suitably receives a third correcting scanning signal AZ3 at the gate thereof.

Here, a P-channel TFT is used for the driving transistor 52 and the switching transistor 59, and an N-channel TFT is used for the sampling transistor 53 and the switching transistors 54 to 56. However, the combination of the conduction types of the driving transistor 52, sampling transistor 53 and switching transistors 54 to 56 and 59 is a mere example and is not used restrictively.

Figure 22:
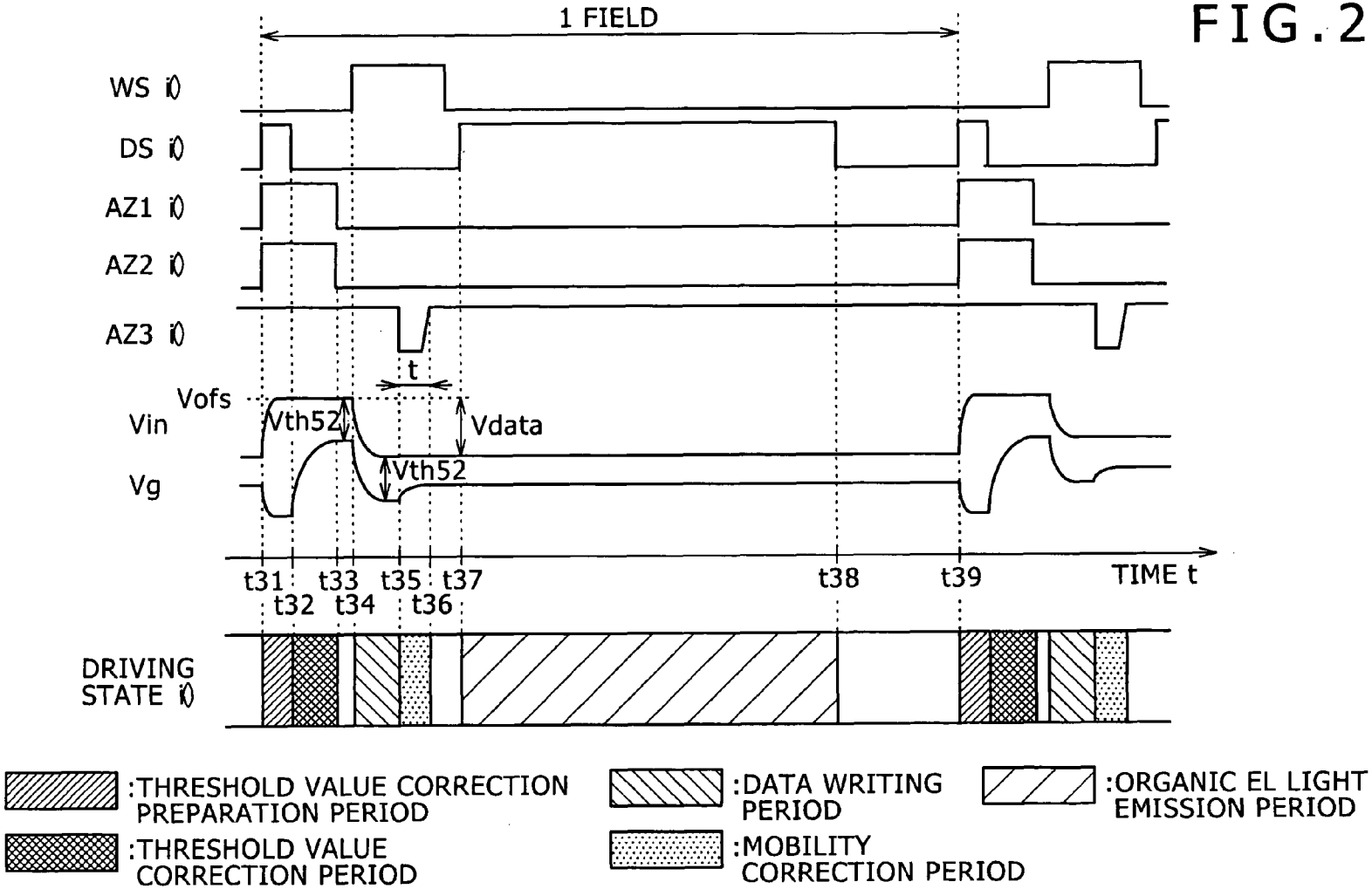
FIG. 22 is a timing waveform diagram illustrating a timing relationship among the writing signal, driving signal and first, second and third correcting scanning signals used in the pixel circuit of FIG. 21 and a variation of the potential at a node and the gate potential of the driving transistor.

FIG. 22 illustrates a timing relationship of the writing signal WS, driving signal DS and first, second and third correcting scanning signals AZ1, AZ2 and AZ3 for driving the pixel circuit 11C and a variation of the potential Vin at the node N21 and the gate potential Vg of the driving transistor 52.

As can be seen apparently from the waveform diagram of FIG. 22, in the present pixel circuit 11C, the function of the switching transistor 55 in the pixel circuit 11B is taken charge of by the two switching transistors 55 and 59. Particularly, the switching transistor 59 takes charge of mobility correction operation. Then, the mobility correction period t35 to t36 is determined from the pulse width of the third correcting scanning signal AZ3, or more particularly from the rising edge waveform of the third correcting scanning signal AZ3.

At this time, since the gate potential of the driving transistor 52 varies in response to the input signal voltage Vsig, the mobility correction time t which depends upon the rising edge waveform of the third correcting scanning signal AZ3 is set so as to increase in inverse proportion to the input signal voltage Vsig so that the mobility correction time t may be determined similarly as in the different pixel circuit 2. Therefore, the dependence of the drain-source current Ids of the driving transistor 52 upon the mobility μ can be canceled with a higher degree of certainty over an overall level range of the input signal voltage Vsig from the black level to the white level. In other words, the mobility μ can be corrected with a higher degree of certainty against the dispersion among different pixels.

The third correcting scanning signal AZ3 which has a rising edge waveform which increases in inverse proportion to the effective input signal voltage Vdata to be applied to the gate of the driving transistor 52 can be produced using a principle (opposite in polarity) same as that of the VDDVx production circuit 40 shown in FIG. 9 similarly to the first correcting scanning signal AZ1. In particular, the third correcting scanning signal AZ3 can be produced by producing a power supply potential VSSVx of an analog waveform having a rising edge waveform which increases in inverse proportion to the effective input signal voltage Vdata to be applied to the gate of the driving transistor 52 and supplying the power supply potential VSSVx as a negative side power supply potential to the buffers 182(*i*) and 183(*i*) of a third correcting scanning circuit having a configuration same as that of the writing scanning circuit 18 shown in FIG. 8.

It is to be noted that different circuit examples of the pixel circuit 11 are not limited to the pixel circuits 11A to 11C described hereinabove. In particular, the present invention can be applied to various display apparatus wherein a plurality of pixel circuits each including, in addition to an electro-optical element, at least a driving transistor for driving the electro-optical element, a sampling transistor for sampling and writing an input signal voltage, and a capacitor connected to the gate of the driving transistor and configured to hold the input signal voltage written by the sampling transistor are disposed in rows and columns. Namely, a plurality of pixel circuits are disposed in a matrix.

Further, in the embodiment described above, the present embodiment is applied to an organic EL display apparatus which uses an organic EL device as an electro-optical element of the pixel circuits 11, 11A, 11B and 11C. However, the present invention is not applied to the applications mentioned but can be applied to various display apparatus which use an electro-optical element (light emitting device) of the current driven type whose light emission luminance varies in response to the value of current flowing therethrough.

It should be understood by those skilled in the art that various modifications, combinations, sub-combinations and alterations may occur depending on design requirements and other factors insofar as they are within the scope of the appended claims or the equivalents thereof.

What is claimed is:

1. A display apparatus, comprising:

a pixel array section wherein a plurality of pixel circuits each including an electro-optical element, a driving transistor configured to drive said electro-optical element, a sampling transistor configured to sample and write an input signal voltage and a capacitor configured to hold a gate-source voltage of said driving transistor within a display period are disposed in a matrix; and dependence cancellation means for negatively feeding back, within a correction period before said electro-optical element emits light in a state wherein the input signal voltage is written by said sampling transistor, drain-source current of said driving transistor to the gate input side of said driving transistor to cancel the dependence of the drain-source current of said driving transistor on the mobility, wherein the time of the correction period is set so as to increase in inverse proportion to the gate-source voltage–threshold voltage of said driving transistor prior to the correction period.

2. The display apparatus according to claim 1, wherein a falling edge waveform or a rising edge waveform of a signal for driving said sampling transistor and/or a falling edge waveform or a rising edge waveform of a signal for driving any of the transistors other than said sampling transistor are set so that the time of the correction period may increase in inverse proportion to the gate-source voltage–threshold voltage of said driving transistor prior to the correction period.

3. The display apparatus according to claim 2, wherein each of said pixel circuits further includes a first switching transistor configured to selectively supply current to said driving transistor, and the time after said first switching transistor enters a conducting state until said sampling transistor enters a non-conducting state is set as the time of the correction period.

4. The display apparatus according to claim 2, wherein the time after said sampling transistor enters a conducting state until said sampling transistor enters a non-conducting state is set as the time of the correction period.

5. The display apparatus according to claim 1, wherein each of said pixel circuits further includes a second switching transistor connected between the gate and the drain of said driving transistor, and a rising edge waveform or a falling edge waveform of a signal for driving said second switching transistor is set so that the time of the correction period may increase in inverse proportion to the gate-source voltage–threshold voltage of said driving transistor prior to the correction period.

6. The display apparatus according to claim 5, wherein the time after said second switching transistor enters a conducting state until said second switching transistor enters a non-conducting state is set as the time of the correction period.

7. The display apparatus according to claim 1, wherein each of said pixel circuits further includes a second switching transistor connected between the gate and the drain of said driving transistor and a third switching transistor connected between a data line for providing the input signal voltage and the drain of said driving transistor, and a rising edge waveform or a falling edge waveform of a signal for driving said third switching transistor is set so that the time of the correction period may increase in inverse proportion to the gate-source voltage–threshold voltage of said driving transistor prior to the correction period.

8. The display apparatus according to claim 1, wherein the time after said third switching transistor enters a conducting state until said third switching transistor enters a non-conducting state is set as the time of the correction period.

9. A driving method for a display apparatus wherein a plurality of pixel circuits each including an electro-optical element, a driving transistor configured to drive said electro-optical element, a sampling transistor configured to sample and write an input signal voltage and a capacitor configured to hold a gate-source voltage of said driving transistor within a display period are disposed in a matrix, comprising the step of negatively feeding back, within a correction period before said electro-optical element emits light in a state wherein the input signal voltage is written by said sampling transistor, drain-source current of said driving transistor to the gate input side of said driving transistor to cancel the dependence of the drain-source current of said driving transistor on the mobility, the time of the correction period being set so as to increase in inverse proportion to the gate-source voltage–threshold voltage of said driving transistor prior to the correction period.

10. A display apparatus, comprising:

a pixel array section wherein a plurality of pixel circuits each including an electro-optical element, a driving transistor configured to drive said electro-optical element, a sampling transistor configured to sample and write an input signal voltage and a capacitor configured to hold a gate-source voltage of said driving transistor within a display period are disposed in a matrix; and a dependence cancellation section configured to negatively feed back, within a correction period before said electro-optical element emits light in a state wherein the input signal voltage is written by said sampling transistor, drain-source current of said driving transistor to the gate input side of said driving transistor to cancel the dependence of the drain-source current of said driving transistor on the mobility, wherein the time of the correction period is set so as to increase in inverse proportion to the gate-source voltage and threshold voltage of said driving transistor prior to the correction period.

* * * * *